US006681836B1

(12) United States Patent
Sakamoto et al.

(10) Patent No.: US 6,681,836 B1
(45) Date of Patent: Jan. 27, 2004

(54) METHOD AND APPARATUS FOR MANUFACTURING SEMI-SOLIDIFIED METAL

(75) Inventors: Kazuya Sakamoto, Tochigi-ken (JP); Nobumasa Hamazoe, Kawagoe (JP); Kenji Ohwada, Utsunomiya (JP); Atsushi Suzuki, Utsunomiya (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/600,623

(22) PCT Filed: Oct. 15, 1999

(86) PCT No.: PCT/JP99/00163

§ 371 (c)(1),
(2), (4) Date: Jul. 20, 2000

(87) PCT Pub. No.: WO99/36209

PCT Pub. Date: Jul. 22, 1999

(30) Foreign Application Priority Data

Jan. 20, 1998 (JP) ..... 10-008847
Jan. 20, 1998 (JP) ..... 10-008849
Jan. 20, 1998 (JP) ..... 10-008857
Jan. 20, 1998 (JP) ..... 10-008864
Jan. 20, 1998 (JP) ..... 10-008872

(51) Int. Cl.[7] ..... B22D 35/06; B22D 41/005; B22D 25/00

(52) U.S. Cl. ..... 164/133; 164/71.1; 164/335; 164/900

(58) Field of Search ..... 164/900, 71.1, 164/133, 335

(56) References Cited

U.S. PATENT DOCUMENTS 4,607,959 A * 8/1986 Miyazaki et al. ..... 366/343
5,144,998 A * 9/1992 Hirai et al. ..... 164/71.1
5,205,981 A * 4/1993 Fujikawa et al. ..... 266/234
5,632,801 A * 5/1997 Lin ..... 75/708

FOREIGN PATENT DOCUMENTS

| | | | |
|---|---|---|---|
| JP | 53-131905 A | | 11/1978 |
| JP | 62-130234 | | 6/1987 |
| JP | 01-192446 A | | 11/1989 |
| JP | 2-280946 | * | 11/1990 |
| JP | 2-290931 | | 11/1990 |
| JP | 03-035846 A | | 2/1991 |
| JP | 3-162533 | | 7/1991 |
| JP | 4-88135 | | 3/1992 |
| JP | 7-185778 | | 7/1995 |
| JP | 07-100589 A | | 8/1995 |
| JP | 7-223047 | | 8/1995 |
| WO | WO 96/15867 A1 | | 5/1996 |

* cited by examiner

*Primary Examiner*—Kuang Y. Lin
(74) *Attorney, Agent, or Firm*—Birch, Stewart, Kolasch & Birch, LLP

(57) ABSTRACT

A predetermined amount of molten metal 12 is supplied to a heat-insulating crucible 18. After that, a chill block 46, which is cooled to a predetermined temperature of not more than a temperature of the molten metal 12, is immersed and rotated in the molten metal 12. Accordingly, the molten metal 12 is agitated while being cooled to give no directivity of cooling. It is possible to obtain semisolidified metal 20 which is formed into slurry uniformly and effectively as a whole. The semisolidified metal 20 is discharged from the heat-insulating crucible 18, and it is supplied to a forming machine 22 to apply a forming treatment thereto. Accordingly, it is possible to produce the desired slurry efficiently and economically.

13 Claims, 29 Drawing Sheets

46

46
52

46
54

46
56

58
60
46
58

MASS PRODUCTION SYSTEM TIME TABLE 144
172a
140a
142a
164a
158
156
162
160
161
172b
140b
142b
164b
176
148
146
182
150
180
178
184
168a
168b
170a
170b 520
542
546
552
554
530
534
558
516
526
566
528
512
(566)
514
524
522
564

METHOD AND APPARATUS FOR MANUFACTURING SEMI-SOLIDIFIED METAL

This application is the national phase under 35 U.S.C. §371 of PCT International Application No. PCT/JP99/00163 which has an International filing date of Jan. 19, 1999, which designated the United States of America.

TECHNICAL FIELD

The present invention relates to a method and an apparatus for producing semisolidified metal to obtain predetermined slurry from molten metal.

BACKGROUND ART

An operation is generally performed to produce semisolidified metal, i.e., slurry in an amount of one shot for the forming process, by using molten metal of, for example, aluminum, magnesium, or alloy thereof. It is known that a forming operation based on the use of slurry especially has such an advantage that the surface accuracy of a formed product is excellent. In order to produce such slurry, for example, the thixocasting process and the rheocasting process are widely adopted.

However, in the case of the thixocasting process described above, it is necessary to use an exclusive billet and a reheating apparatus. For this reason, the following problems are pointed out. That is, the material cost and the equipment cost are considerably expensive, and the entire production operation is complicated.

On the other hand, in the rheocasting process, the mass production is performed based on the continuous batch system. In this process, the cooling is performed by discharging the molten metal while allowing the molten metal to make contact with a cooling section cooled with water. Therefore, the temperature of slurry differs between the start and the end of the cooling. A problem arises in that the temperature of the slurry is not managed accurately.

A method is also known, in which slurry is produced in accordance with cooling, heating, and agitation in a forming machine. However, the following inconveniences arise. That is, the cycle time is prolonged, and especially the shot weight is increased.

When the produced slurry is supplied into the forming machine, a container for accommodating the, slurry is usually inverted in the vertical direction. However, it is difficult to discharge the entire amount of slurry in the container, for example, due to the temperature of the slurry in the container, the shape of the container, and the weight of the slurry. As a result, the following problems are pointed out. That is, remaining matters of the slurry appear in the container, and the supply weight of the slurry is dispersed. Further, the slurry, which:is newly produced in the container, is badly affected thereby.

When different parts are formed, the shot weight differs depending thereon. Therefore, the following problems are pointed out. That is, it is impossible to correctly manage the temperature of the slurry. When the shot weight is increased, it takes a long time to perform the operation for producing the slurry. It is difficult to efficiently perform the forming operation for a variety of different parts to give high qualities.

An object of the present invention is to provide a method and an apparatus for producing semisolidified metal, which make it possible to produce desired slurry efficiently and economically.

Another object of the present invention is to provide an apparatus for producing semisolidified metal, which makes it possible to economically produce desired slurry and easily discharge the slurry in a reliable manner.

Still another object of the present Invention is to provide an apparatus for producing semisolidified metal, which makes it possible to economically produce various slurries having different weight so that they have high qualities, wherein the system is simplified.

DISCLOSURE OF THE INVENTION

According to the present invention, a predetermined amount of molten metal is supplied to a heat-insulating crucible. After that, the molten metal in the crucible is cooled by the aid of a cooling member which is cooled to be at a predetermined temperature of not more than a temperature of the molten metal. Simultaneously, the molten metal is agitated. Accordingly, in the heat-insulating crucible, the molten metal is reliably formed into slurry generally uniformly as a whole without involving any directivity of cooling. Thus, the reheating is unnecessary, and it is possible to efficiently obtain desired semisolidified metal.

According to the present invention, a predetermined amount of molten metal is supplied to a heat-insulating crucible, and then the molten metal in the crucible is cooled by the aid of a cooling member which is cooled to be at a predetermined temperature of not more than a temperature of the molten metal. Further, the cooling member is moved in the horizontal direction and/or in the vertical direction while rotating the cooling member. Thus, the molten metal is agitated. For example, the cooling member is moved in a reciprocating manner in the horizontal direction and/or in the vertical direction. Alternatively, the cooling member is moved spirally in the horizontal direction.

Accordingly, especially when heat-insulating crucibles having various shapes are used, the cooling member is moved along with the shape of the heat-insulating crucible. Thus, the directivity of cooling is excluded to be as less as possible, and the molten metal can be effectively agitated. Accordingly, the molten metal is formed into slurry uniformly and reliably as a whole. It is possible to obtain desired semisolidified metal efficiently with a high quality.

In the present invention, the semisolidified metal is produced after a predetermined amount of molten metal is supplied to a heat-insulating crucible, by cooling and agitating the molten metal in the heat-insulating crucible by the aid of a plurality of cooling members. Accordingly, even when the shot weight is increased, then the directivity of cooling is avoided to be as less as possible, and it is possible to quickly and smoothly obtain the desired semisolidified metal formed into slurry uniformly and reliably as a whole.

Further, the cooling members are integrally held by a driving mechanism by the aid of a fixing means in a state in which an arbitrary number of the cooling members are stacked with each other. Therefore, it is enough to change the number of stacked cooling members depending on the change of the shot weight. Thus, it is possible to produce the desired semisolidified metal efficiently to have a high quality. The fixing means includes a shaft member for being integrally inserted into the plurality of stacked cooling members, and a fixture for being screwed on an end of the shaft member. Thus, it is possible to effectively simplify the structure.

In the present invention, the molten metal is supplied into a heat-insulating crucible, and then a cooling member is immersed in the molten metal. The molten metal is agitated in a state in which a cooling medium having a predetermined temperature is supplied to the inside of the cooling member. Accordingly, the directivity of cooling is avoided to be as less as possible, and it is possible to convert the molten metal into slurry quickly and reliably. Further, when the temperature of the cooling medium is managed, it is unnecessary to reheat the semisolidified metal. Thus, it is possible to efficiently obtain the desired semisolidified metal.

In the present invention, a predetermined amount of molten metal is supplied to divided type heat-insulating crucibles. After that, the molten metal in the heat-insulating crucibles is cooled and agitated by the aid of a cooling member to produce semisolidified metal. Subsequently, the heat-insulating crucibles are subjected to opening/closing operation by the aid of an opening/closing mechanism. Accordingly, the semisolidified metal in the heat-insulating crucibles falls in accordance with its self-weight, and it is discharged from the heat-insulating crucibles.

Accordingly, the directivity of cooling is avoided to be as less as possible, and it is possible to obtain the desired semisolidified metal formed into slurry uniformly and reliably as a whole. Further, it is possible to discharge the semisolidified metal from the heat-insulating crucibles smoothly and reliably.

BEST MODE FOR CARRYING OUT THE INVENTION

Figure 1:
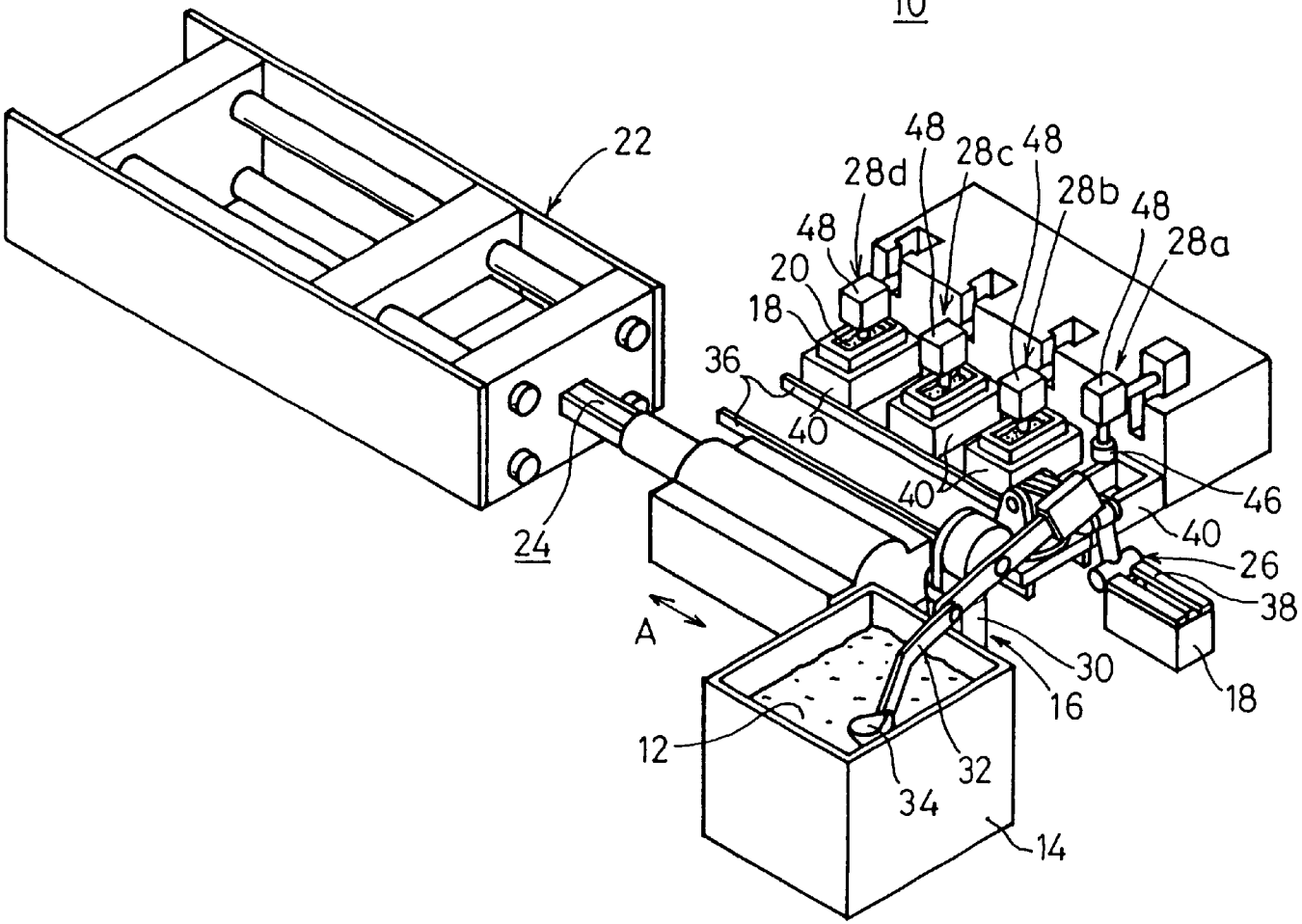
FIG. 1 shows an illustrative schematic perspective view depicting a production apparatus for carrying out a method for producing semisolidified metal according to a first embodiment of the present invention.
Figure 2:
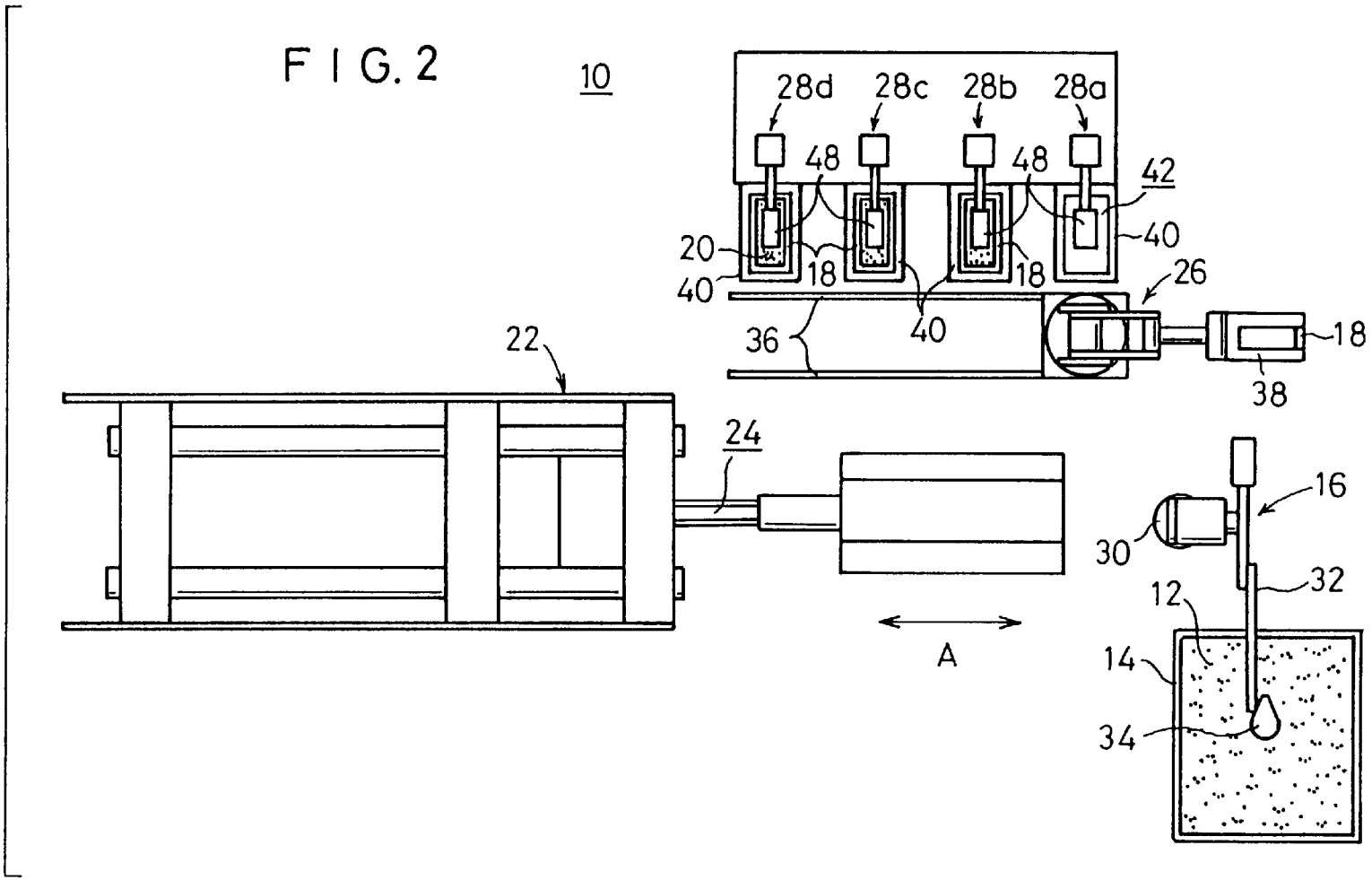
FIG. 2 shows an illustrative plan view depicting the production apparatus.

FIG. 1 shows an illustrative schematic perspective view is depicting a production apparatus 10 for carrying out a method for producing semisolidified metal according to the first embodiment of the present invention, and FIG. 2 shows an illustrative plan view depicting the production apparatus 10.

The production apparatus 10 comprises a molten metal-holding furnace 14 for holding molten metal 12 which is composed of melted metal such as aluminum, alloy thereof, magnesium, and alloy thereof; a molten metal-ladling robot 16 for ladling a predetermined amount (amount for one shot) of the molten metal 12 from the molten metal-holding furnace 14; a supply robot 26 for pouring the molten metal 12 ladled by the molten metal-ladling robot 16 into a predetermined heat-insulating crucible 18, and supplying semisolidified metal 20 formed into a desired slurry state in the crucible 18 to a slurry-introducing port 24 which communicates with an unillustrated cavity of a forming machine 22; and first to fourth agitators 28*a* to 28*d* each of which is arranged for the crucible 18 for cooling and agitating the molten metal 12 in the crucible 18.

Figure 3:
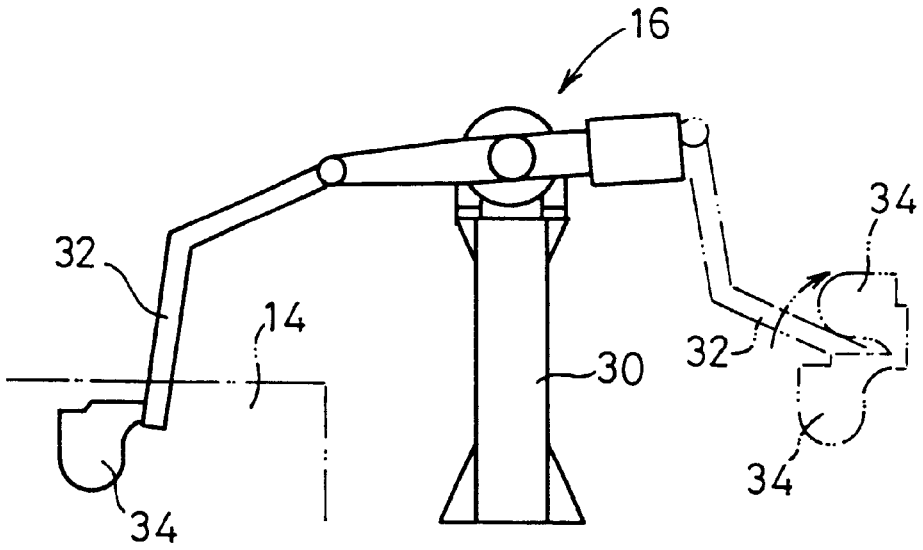
FIG. 3 illustrates the operation of a molten metal-ladling robot which constructs the production apparatus.

As shown in FIGS. 1 and 3, the molten metal-ladling robot 16 includes an arm 32 which is provided swingably on a support pillar 30. A ladle 34 is installed tiltably to the forward end of the arm 32. The supply robot 26 is movable back and forth along a rail 36 which extends in a direction (direction of the arrow A) of arrangement of the first to fourth agitator 28*a* to 28*d*. The supply robot 26 is an articulated type robot, and it has, at its forward end, a gripping section 38 capable of holding the heat-insulating crucible 18.

Figure 4:
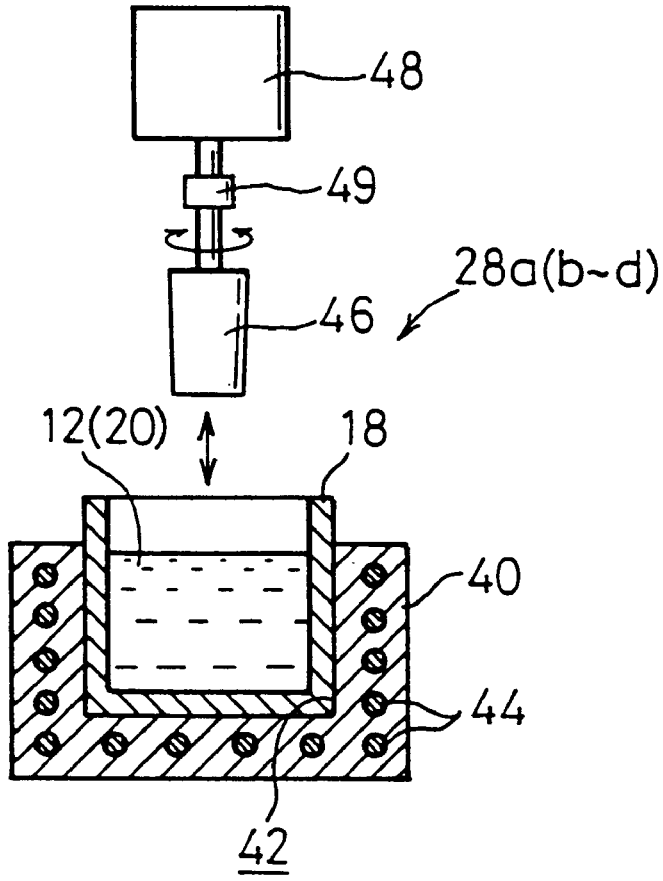
FIG. 4 illustrates an agitator which constructs the production apparatus.

The first agitator 28*a* includes a crucible holder 40 on which the crucible 18 is detachably arranged. As shown in FIG. 4, the crucible holder 40 is provided with a recess 42 for accommodating the crucible 18. A heater 44 is embedded at the inside of the crucible holder 40 so that the heater 44 circumscribes the crucible 18 arranged in the recess 42.

A chill block (cooling member) 46, which also has an agitating function, is detachably arranged with a driving mechanism 48 at a position over the crucible holder 40. The chill block 46 is made of, for example, a material such as copper and stainless steel which is not melted at the molten temperature of aluminum molten metal to be used as the molten metal 12. The external shape of the chill block 46 is designed to have a columnar configuration, with a draft sloped downwardly.

The chill block 46 is detachable with respect to a driving mechanism 48 by the aid of a coupler 49 made of ceramics. The driving mechanism 48 is moved upwardly and downwardly over the crucible holder 40, and it drives and rotates the chill block 46.

The second to fourth agitators 28*b* to 28*d* are constructed in the same manner as the first agitator 28*a* described above. The same constitutive components are designated by the same reference numerals, detailed explanation of which will be omitted.

Each of the chill blocks 46 is detachable with respect to each of the driving mechanisms 48 provided for the first to fourth agitators 28*a* to 28*d*. The chill block 46 is detached from the driving mechanism 48 every time when the molten metal 12 is agitated and cooled (for every one shot), and it is fed to a chill block-treating unit 50.

As shown in FIGS. 5A to 5E, the chill block-treating unit 50 comprises a cooling tank 52 for cooling the chill block 46 disengaged from the driving mechanism 48 with a cooling medium such as cooling oil; an air blow means 54 for effecting air blow against the chill block 46 after the cooling to remove solidified matters of aluminum from the surface; a coating tank 56 for immersing the chill block 46 after the air blow in a coating liquid composed of a ceramic material; and a drying means 60 for drying the chill block 46 after the coating with a heater 58.

Figure 6:
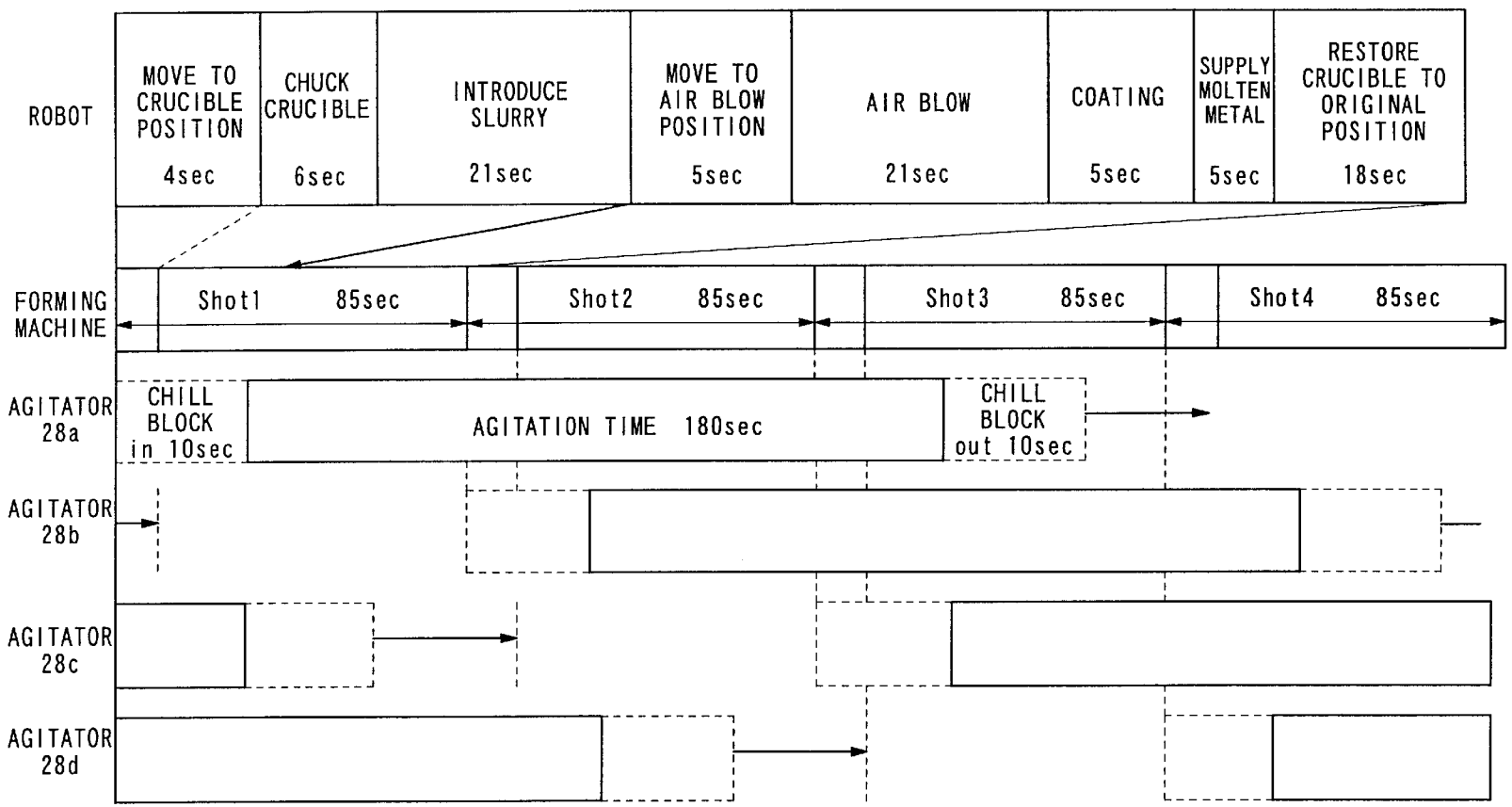
FIG. 6 shows a time table for a mass production system based on the use of the production apparatus.

The operation of the production apparatus 10 constructed as described above will be explained below. FIG. 6 shows a time table for the mass production system based on the use of the production apparatus 10.

At first, the molten metal-ladling robot-16 is operated in a state in which the molten metal 12 is heated and maintained at about 650° C. in the molten metal-holding furnace 14. As shown in FIG. 3, the molten metal-ladling robot 16 is operated as follows. That is, the ladle 34 is inserted into the molten metal-holding furnace 14 in accordance with the action of the arm 32. The ladle 34 is inclined or tilted, so that the molten metal 12 in an amount of one shot is ladled by the ladle 34. The ladle 34, which has ladled the molten metal 12, is moved to a pouring position (see the position depicted by two-dot chain lines in FIG. 3). On the other hand, the supply robot 26, which holds the empty crucible 18, is arranged at the pouring position by the aid of the gripping section 38 (see FIG. 1).

In this situation, the ladle 34 is tilted, and the molten metal 12 in the amount of one shot is poured into the crucible 18 held by the supply robot 26. Subsequently, the supply robot 26 inserts the crucible 18 at a predetermined position of each of the first to fourth agitators 28*a* to 28*d*, for example, into the recess 42 of the crucible holder 40 which constitutes the first agitator 28*a*. The heater is operated in the crucible holder 40 to maintain a predetermined temperature beforehand. The molten metal 12 in the crucible 18 arranged in the recess 42 is prevented from being cooled all at once by the surroundings.

In the first agitator 28*a*, the chill block 46 is previously heated and maintained at about 100° C. in order to remove any moisture and stabilize the cooling condition. The chill block 46 is immersed in the molten metal 12 in the crucible 18 while being rotated in a predetermined direction at a relatively low speed by the aid of the driving mechanism 48. After that, the rotation speed of the chill block 46 is increased in the molten metal 12 in accordance with the action of the driving mechanism 48. Thus, the molten metal 12 is quickly agitated while being cooled.

After the chill block 46 agitates the molten metal 12 for a preset period of time or until a slurry,supply signal is inputted, the chill block 46 is raised and withdrawn from the crucible 18 while being rotated. Accordingly, the semisolidified metal 20, which is maintained to have a constant temperature as a whole, is obtained in the heat-insulating crucible 18.

Figure 7:
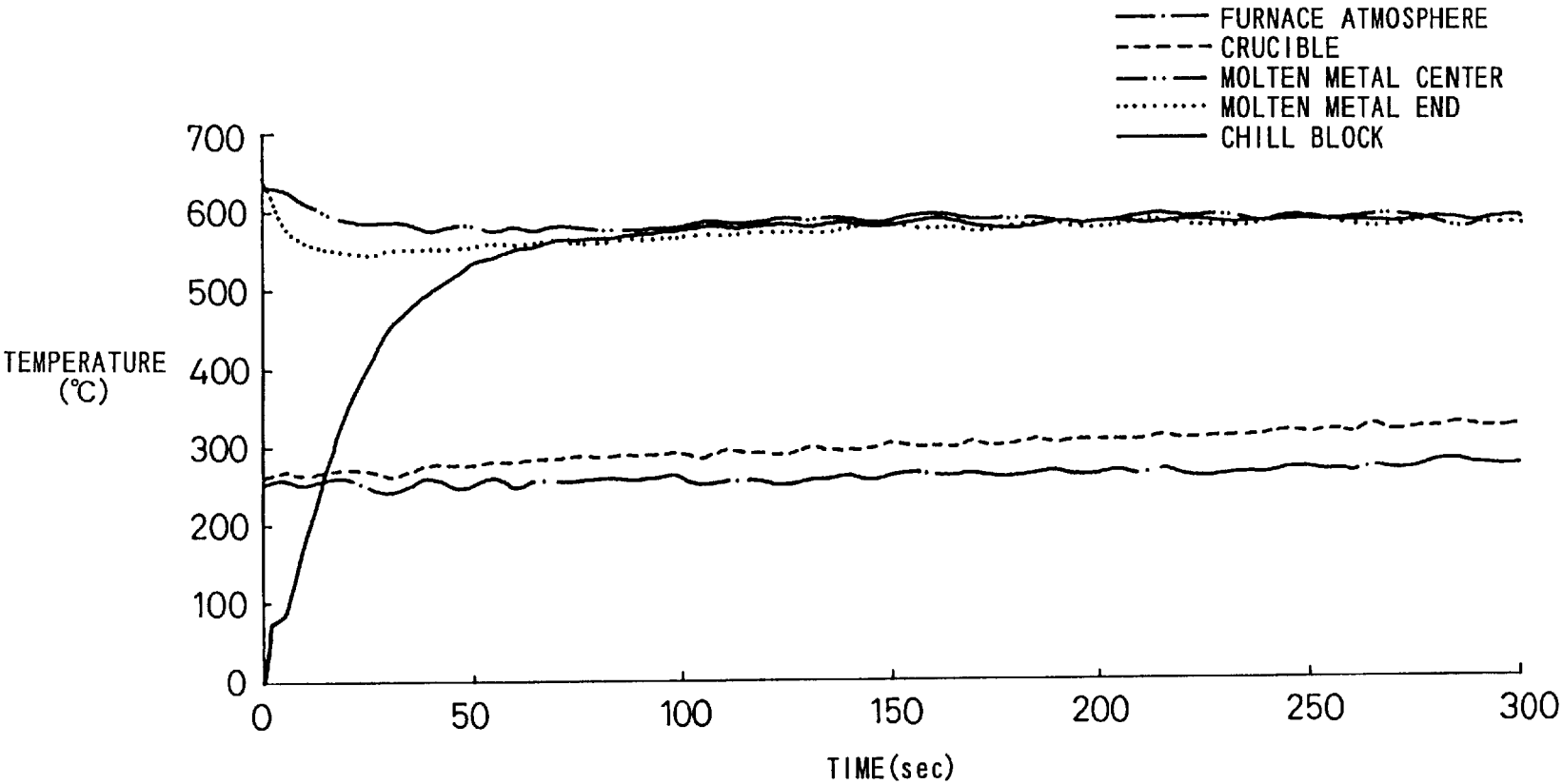
FIG. 7 illustrates the temperature change of each of portions in a crucible during the operation of the production apparatus.

Changes occur as shown in FIG. 7 in the steps for producing the semisolidified metal 20 described above, concerning the atmosphere in the crucible 18, the temperature of the crucible 18, the center temperature of the molten metal 12, the end temperature of the molten metal 12, and the temperature of the chill block 46.

Figure 8:
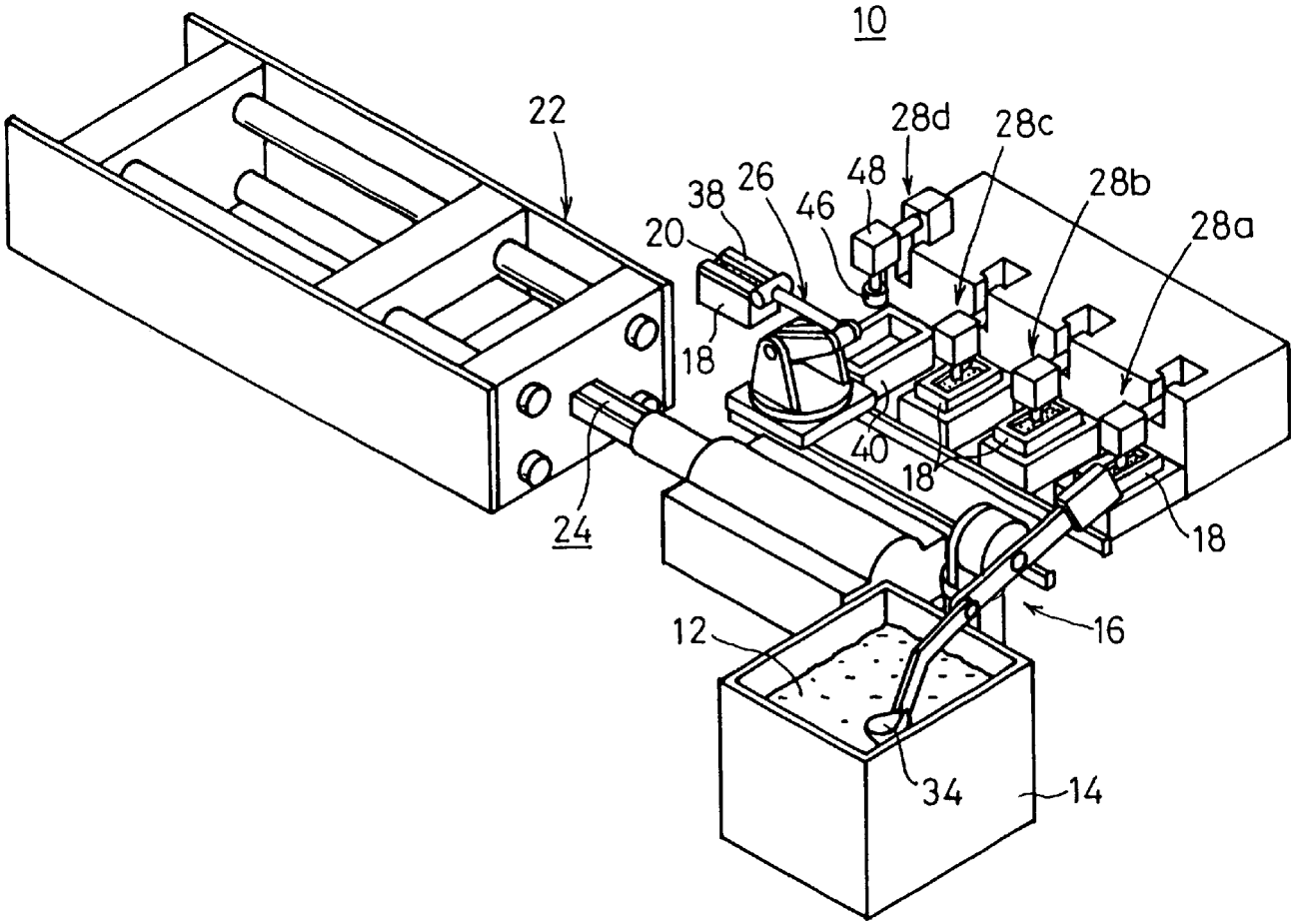
FIG. 8 shows an illustrative perspective view depicting the operation of the production apparatus.

On the other hand, the supply robot 26 is moved, for example, corresponding to the fourth agitator 28*d* which possesses the semisolidified metal 20 cooled and agitated to give a desired slurry state, of the first to fourth agitators 28*a* to 28*d*. In the fourth agitator 28*d*, the driving mechanism 48 waits at an upward position, and the chill block 46 is removed. The supply robot 26 grips the crucible 18 which is arranged on the crucible holder 40 of the fourth agitator 28*d*, and it takes the crucible 18 out of the fourth agitator 28*d* (see FIG. 8).

The supply robot 26 is further operated such that the crucible 18, which is gripped by the gripping section 38, is arranged with respect to the slurry-introducing port 24 of the forming machine 22, and then the crucible 18 is inverted.

Figure 9:
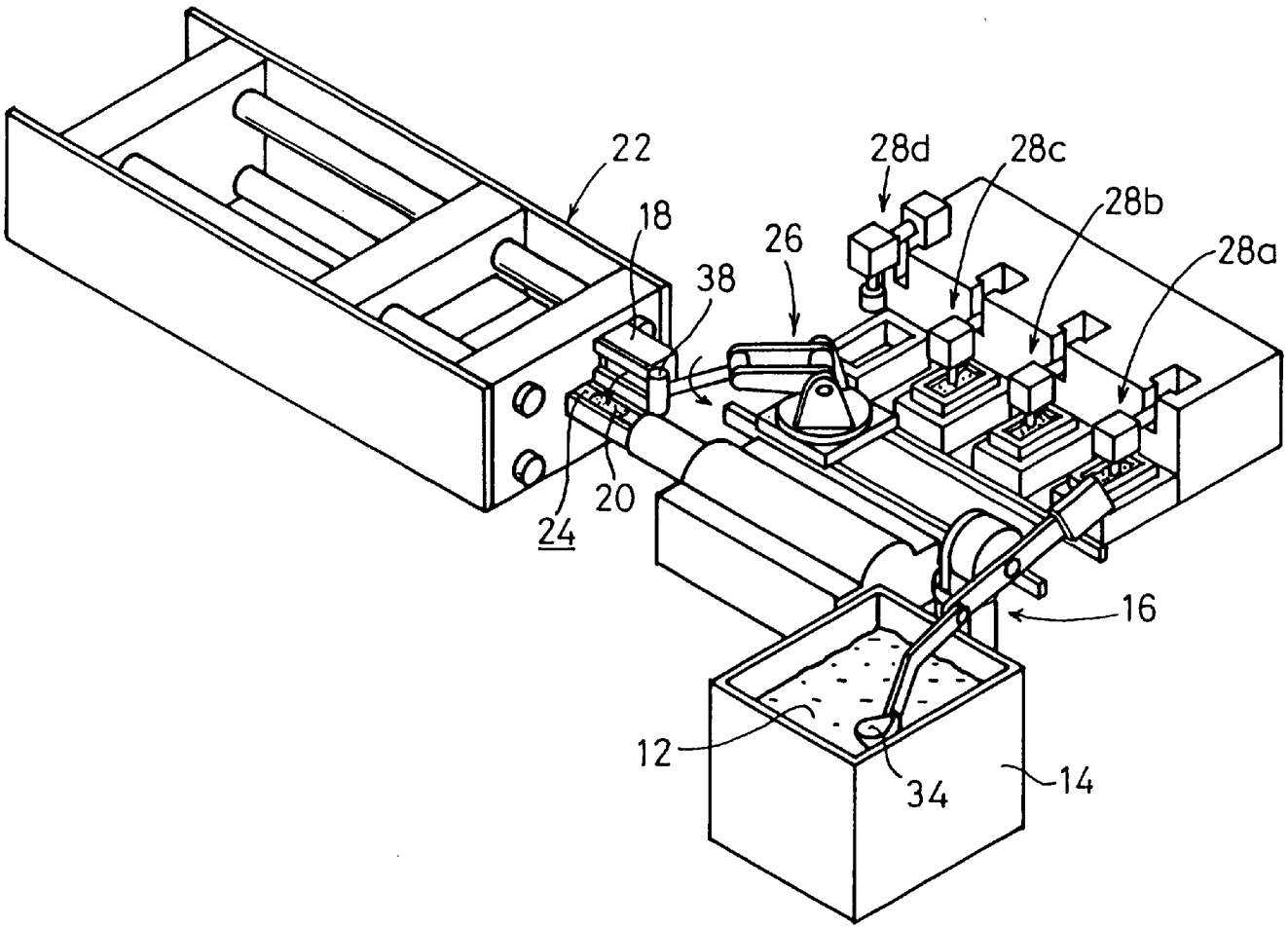
FIG. 9 shows an illustrative perspective view depicting the operation of the production apparatus.

Accordingly, the semisolidified metal 20 in the crucible 18 is allowed to fall so that it falls to be supplied to the slurry-introducing port 24 (see FIG. 9). In the forming machine 22, the forming process is performed with the semisolidified metal 20 to obtain a predetermined formed product.

The supply robot 26 moves the empty crucible 18 to the air blow position to apply the air blow treatment thereto. Accordingly, any aluminum, which remains in the heat-insulating crucible 18, is removed. Subsequently, the inside of the crucible 18 is subjected to coating with a ceramic material or the like, and then the crucible 18 is arranged at the pouring position.

Figures 5A, 5B, 5C, 5D, 5E:
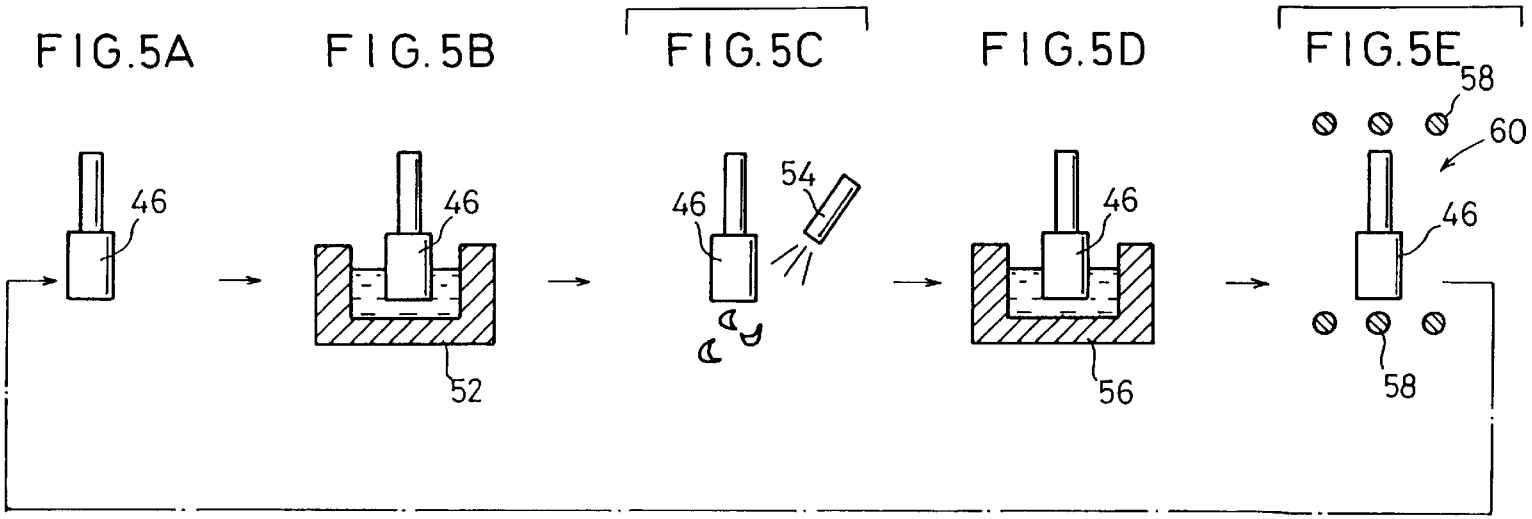
FIGS. 5A to 5E illustrate a chill block-treating unit for treating a chill block which constructs the agitator.

In the first agitator 28*a*, the chill block 46, which is retracted upwardly after performing the cooling and the agitation for the molten metal 12, is disengaged from the driving mechanism 48, and it is transported to the chill block-treating unit 50 by the aid of a robot or the like (see FIG. 5A). In the chill block-treating unit 50, as shown in FIG. 5B, the chill block 46 is firstly immersed in the cooling tank 52 to perform the cooling treatment. After that, the air blow means 54 is used to remove aluminum solidified matters adhered to the surface of the chill block 46 (see FIG. 5C). Further, as shown in FIG. 5D, the chill block 46 is immersed in a coating liquid in the coating tank 56 to coat the surface thereof with a ceramic material, because of the following reason. That is, the surface of the chill block 46 is prevented from any reaction with the molten metal 12, and it is easy to remove aluminum solidified matters adhered to the surface of the chill block 46.

The chill block 46 after the coating treatment is subjected to the drying treatment in accordance with the action of the heater 58 which constitutes the drying means 60. The chill block 46 is heated to a predetermined temperature (see FIG. 5E). After the drying, the chill block 46 is installed to the driving mechanism. 48, and it is used again to perform the cooling and agitating operations for the new molten metal 12.

In the first embodiment of the present invention, the molten metal 12 in the crucible 18 is cooled by using the chill block 46 which is maintained at the temperature lower than the temperature of the molten metal 12. The chill block 46 is rotated to effect the agitation. Accordingly, no directivity occurs during the cooling of the molten metal 12. It is possible to obtain the semisolidified metal 20 formed into the slurry uniformly and reliably as a whole. It is possible to supply the semisolidified metal 20 to the slurry-introducing port 24 of the forming machine 22 without heating the semisolidified metal 20 again.

As a result, it is possible to always obtain the stable semisolidified metal 20 for every one shot. Further, it is unnecessary to provide any equipment such as the reheating apparatus. Accordingly, the effect can be obtained such that it is possible to produce the semisolidified metal 20 economically and efficiently. Further, the external shape of the chill block 46 is designed to have the columnar configuration. It is possible to effectively prevent the chill block 46 from being deteriorated by the molten metal 12 formed into the slurry. The chill block 46 has the draft which is sloped downwardly. Accordingly, it is possible to smoothly withdraw the chill block 46 from the semisolidified metal 20.

In the first embodiment, the air blow means 54 is used to remove the aluminum solidified matters adhered to the surface of the chill block 46. However, in place of the air blow means 54, it is possible to use, for example, a vibration-generating means and a sandblast means.

In the first embodiment, the molten metal-ladling robot 16 for ladling the molten metal in the amount of one shot is provided between the molten metal-holding furnace 14 and the supply robot 26. However, it is not necessarily indispensable to use the molten metal-lading robot 16 provided that the apparatus is constructed such that the molten metal 12 in the amount of one shot is directly fed from the molten metal-holding furnace 14 to the crucible 18 held by the supply robot 26.

Figure 10:
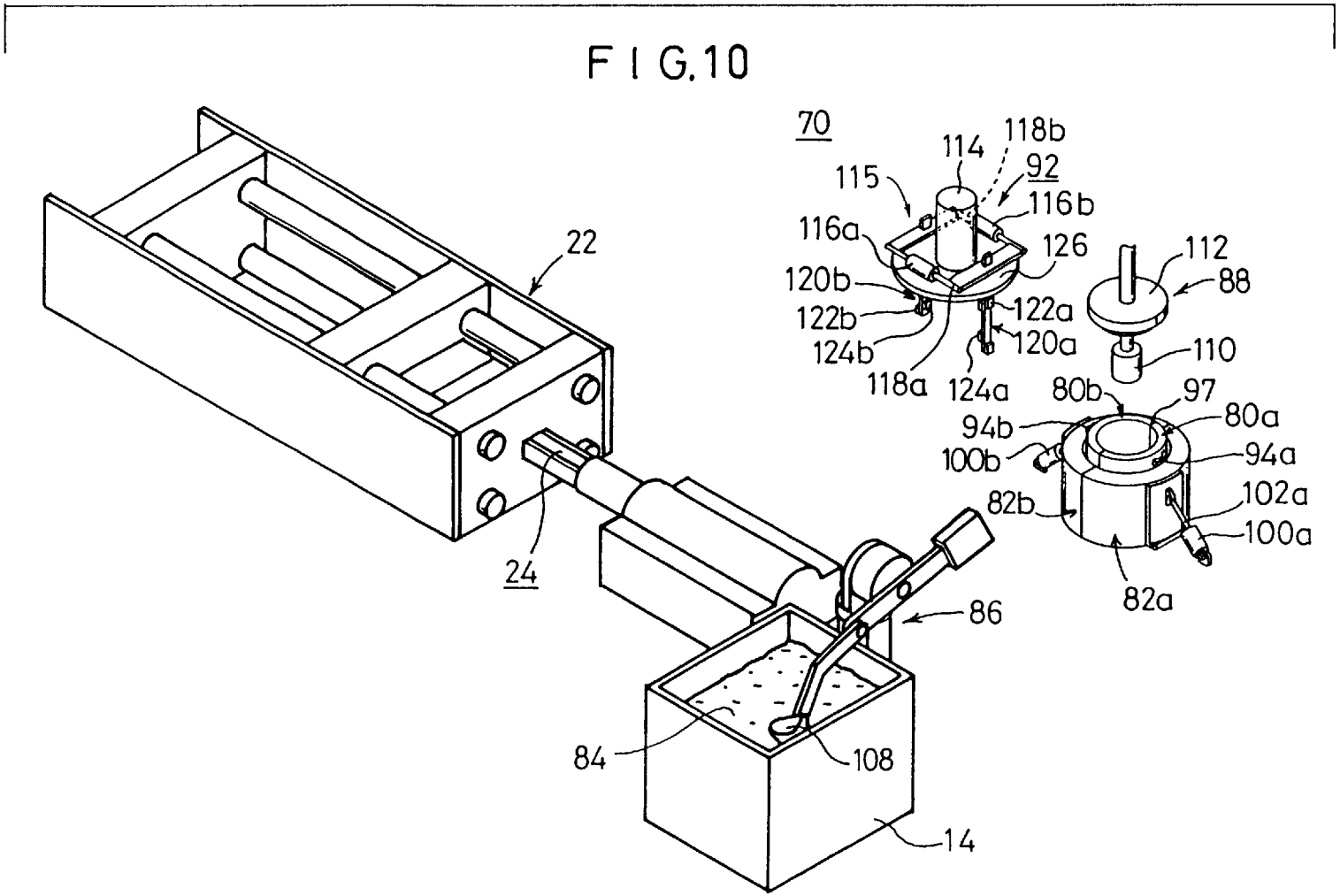
FIG. 10 shows an illustrative schematic perspective view depicting a production apparatus for carrying out a method for producing semisolidified metal according to a second embodiment of the present invention.

FIG. 10 shows an illustrative schematic perspective view depicting a production apparatus 70 for carrying out a method for producing semisolidified metal according to the second embodiment of the present invention.

The production apparatus 70 comprises divided type crucibles 80*a*, 80*b*; divided type crucible holders 82*a*, 82*b* for accommodating the crucibles 80*a*, 80*b*; a molten metal-feeding means 86 for feeding molten metal 84 into the crucibles 80*a*, 80*b*; an agitator 88 for cooling and agitating the molten metal 84 in the crucibles 80*a*, 80*b*; and a supply robot 92 for integrally holding the crucibles 80*a*, 80*b* to take them out of the crucible holders 82*a*, 82*b*, and feeding semisolidified metal 90 to the forming machine 22.

The crucibles 80*a*, 80*b* are constructed by dividing a bottom-equipped cylinder into two in the diametral direction. A pair of hook-shaped projections 94*a*, 94*b* and a pair of grooves 96*a*, 96*b* are arranged linearly in the axial direction on the outer circumferences of the crucibles 80*a*, 80*b* respectively (see FIG. 11A). A heat-resistance packing 97 is interposed between joining surfaces of the crucibles 80*a*, 80*b*.

Figures 11A, 11B, 11C, 11D, 11E, 11F:
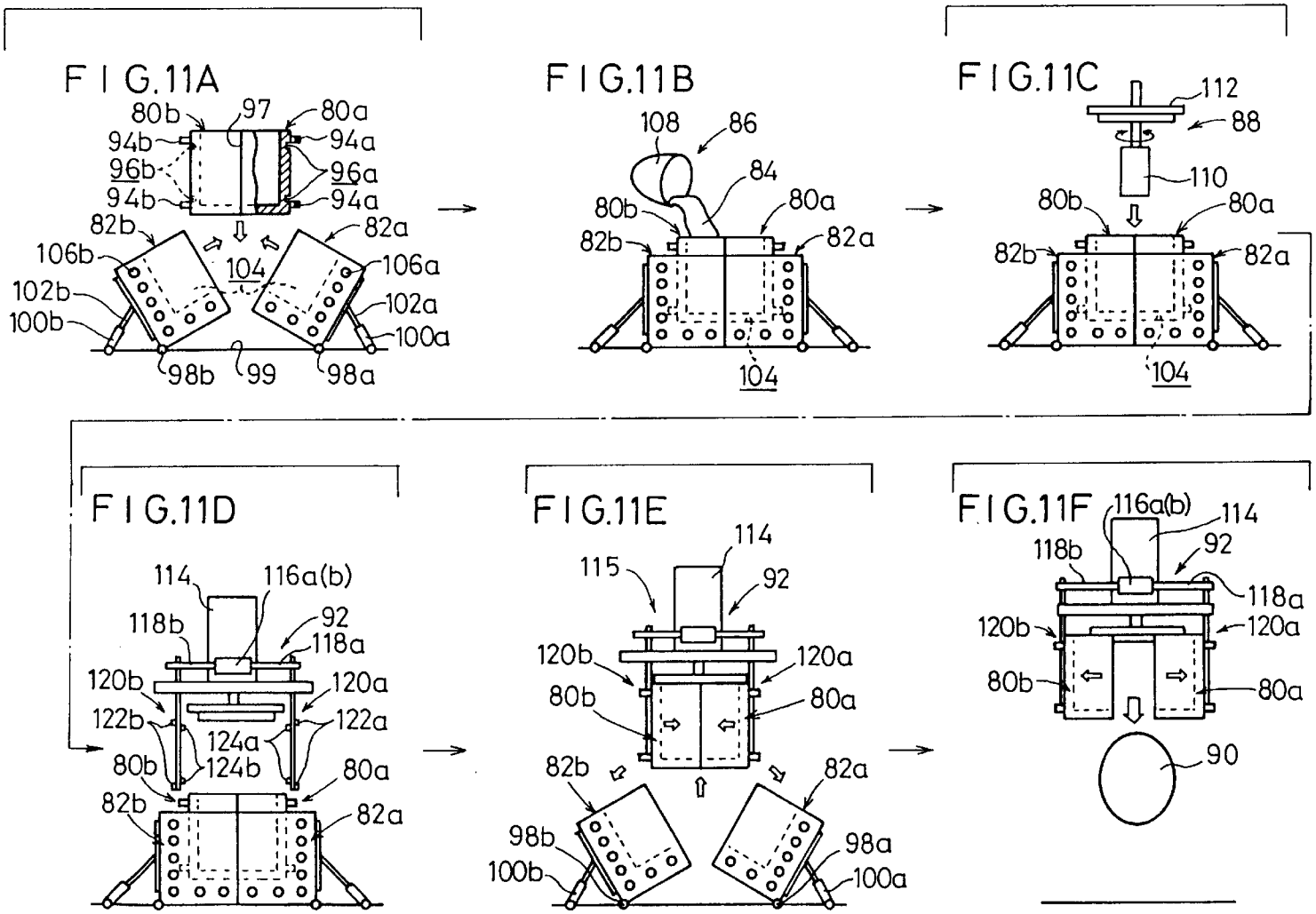
FIGS. 11A to 11F show steps illustrating the operation of the production apparatus.

As shown in FIG. 11A, the crucible holders 82*a*, 82*b* are constructed by dividing a bottom-equipped cylinder into two in the diametral direction. The crucible holders 82*a*, 82*b* are swingably supported at supporting points 98*a*, 98*b* of their respective lower end angular portions with respect to an installation plane 99. Rods 102*a*, 102*b*, which extend from cylinders 100*a*, 100*b*, are connected to side portions of the crucible holders 82*a*, 82*b*, while the cylinders 100*a*, 100*b* are tiltable with respect to the installation plane 99.

When the crucible holders 82*a*, 82*b* are closed, a recess 104 is integrally formed therein. Heaters 106*a*, 106*b* are embedded to circumscribe the recess 104.

As shown in FIG. 10, the molten metal-feeding means 86 is provided with a ladle 108 for ladling the molten metal 84 in an amount of one shot from the molten metal-holding furnace 14. The ladle 108 is constructed tiltably and movably between the ladling position for the molten metal 84 and the pouring position for the crucibles 80*a*, 80*b*.

The agitator 88 is provided with a chill block (cooling member) 110 which is made of, for example, stainless steel. The external shape of the chill block 110 is designed to have a columnar configuration. The chill block 110 is rotatable and movable upwardly and downwardly by the aid of an unillustrated driving mechanism. The chill block 110 is inserted rotatably into a lid member 112. The lid member 112 is movable upwardly and downwardly in an integrated manner together with the chill block 110. It is desirable that the lid member 112 is made of a material having no gas permeability. The surface, which makes contact with the molten metal 84, is designed to be a planar surface or to have a conical or pyramidal configuration protruding toward the molten metal 84 at its central portion.

The supply robot 92 is provided with a wrist section 114. An opening/closing mechanism 115 is installed to the wrist section 114. The opening/closing mechanism 115 has cylinders 116*a*, 116*b* which serve as forward/backward moving means. Ends of arm members 120*a*, 120*b* disposed vertically downwardly are secured to rods 118*a*, 118*b* which extend in mutually opposite directions from the cylinders 116*a*, 116*b*. The arm members 120*a*, 120*b* are provided with a pair of outer projections 122*a*, 122*b* which are inserted into and engaged with the respective projections 94*a*, 94*b* of the crucibles 80*a*, 80*b*, and a pair of inner projections 124*a*, 124*b* which are fitted to the grooves 96*a*, 96*b* of the crucibles 80*a*, 80*b*.

A lid member 126, which is positioned under the opening/closing mechanism 115 and which is made of a heat-insulating material, is secured to the supply robot 92. The lid member 126 makes tight contact with the upper surfaces of the crucibles 80*a*, 80*b* to ensure the heat-insulating performance of the crucibles 80*a*, 80*b* when the crucibles 80*a*, 80*b* are held by the arm members 120*a*, 120*b*. The lid member 126 also functions to avoid any leakage of the semisolidified metal 90.

In the second embodiment constructed as described above, the crucibles 80*a*, 80*b* are firstly inserted between the crucible holders 82*a*, 82*b* in a state in which the crucible holders 82*a*, 82*b* are mutually open to stand on the supporting points 98*a*, 98*b* as shown in FIG. 11A. Subsequently, the cylinders 100*a*, 100*b* are operated to displace the rods 102*a*, 102*b* frontwardly respectively. Accordingly, the crucible holders 82*a*, 82*b* make swinging movement in directions to make approach to one another. Therefore, the crucibles 80*a*, 80*b* are accommodated in the recess 104 which is formed integrally between the crucible holders 82*a*, 82*b*. In this arrangement, the size of the recess 104 is designed to be slightly smaller than the external shape of the crucibles 80*a*, 80*b*. The crucibles 80*a*, 80*b* are held in a liquid-tight manner with each other with the heat-resistance packings 97 intervening therebetween in a state in which the crucible holders 82*a*, 82*b* are mutually closed.

Subsequently, as shown in FIG. 11B, the ladle 108, which constitutes the molten metal-feeding means 86, ladles the molten metal 84 in the amount of one shot, and the molten metal 84 is fed into the crucibles 80*a*, 80*b*. The crucibles 80*a*, 80*b* are heated and held at a predetermined temperature (for example, 280° C.) by the aid of the heaters 106*a*, 106*b* embedded in the crucible holders 82*a*, 82*b*. The molten metal 84, which is aluminum molten metal maintained at 650° C. to 700°0 C., is fed into the crucibles 80*a*, 80*b*.

On the other hand, in the agitator 88, the chill block 110 is heated to 100°0 C. in order to remove, for example, moisture. As shown in FIG. 11C, the chill block 110 is moved downwardly from a position over the crucibles 80*a*, 80*b* while being rotated. Accordingly, the chill block 110 cools the molten metal 84 in the crucibles 80*a*, 80*b*, and it agitates the molten metal 84. More preferably, the chill block 110 is immersed in the molten metal 84 in the crucibles 80*a*, 80*b* while being rotated in a predetermined direction at a relatively low speed. After that, the rotation speed of the chill block 110 is increased in the molten metal 84. Accordingly, the chill block 110 quickly agitates the molten metal 84 while cooling the molten metal 84.

During this process, the lid member 112 is moved downwardly integrally with the chill block 110. The lid member 112 is arranged on the open upper end side of the crucibles 80*a*, 80*b*. Accordingly, the surface of the molten metal 84 is not oxidized during the cooling and the agitation effected by the chill block 110. Further, it is possible to reliably avoid any contamination of air into the molten metal 84.

The cooling and the agitation are performed for a predetermined period of time to obtain the semisolidified metal 90 in a desired slurry state. After that, the chill block 110 is taken out of the crucibles 80*a*, 80*b* while being rotated. On the other hand, the supply robot 92 is arranged over the crucibles 80*a*, 80*b*. The supply robot 92 is operated such that the arm members 120*a*, 120*b* are moved downwardly by the aid of the wrist section 114 (see FIG. 11D). The respective outer projections 122*a*, 122*b* are fitted to the projections 94*a*, 94*b* of the crucibles 80*a*, 80*b*. The respective inner projections 124*a*, 124*b* are fitted to the grooves 96*a*, 96*b* of the crucibles 80*a*, 80*b*.

Subsequently, as shown in FIG. 11E, the crucible holders 82*a*, 82*b* make swinging movement in directions to make separation from each other in accordance with the action of the cylinders 100*a*, 100*b*. The crucibles 80*a*, 80*b*, which have been held by the recess 104, are taken out in a state of being held by the arm members 120*a*, 120*b*. The wrist section 114 is arranged at a position over the slurry-introducing port 24 of the forming machine 22. After that, the cylinder 116*a*, 116*b*, which construct the opening/closing mechanism 115, are operated to displace the rods 118*a*, 118*b* in directions to make separation from each other.

Therefore, the arm members 120*a*, 120*b* are displaced in directions to make separation from each other. The crucibles 80*a*, 80*b*, which are held by the arm members 120*a*, 120*b*, are released from each other. The semisolidified metal 90 is produced integrally in the crucibles 80*a*, 80*b*. When the crucibles 80*a*, 80*b* are open, then the semisolidified metal 90 falls, and it is supplied to the slurry-introducing port 24 (see FIG. 11F).

As described above, in the second embodiment, the molten metal 84 in the amount of one shot, which is fed into the crucibles 80*a*, 80*b*, are agitated in accordance with the rotating action of the chill block 110 while being cooled by the chill block 110. Accordingly, it is possible to obtain the semisolidified metal 90 in a satisfactory slurry state, which has no directivity of cooling and which is uniform as a whole. Further, the open ends of the crucibles 80*a*, 80*b* are closed by the lid member 112 during the cooling and the agitation effected by the chill block 110. Therefore, it is possible to effectively avoid any oxidation of the surface of the molten metal 84 and any contamination of air into the molten metal 84. Accordingly, such an effect is obtained that the semisolidified metal 90 having a high quality can be efficiently obtained.

The apparatus further includes the divided type crucibles 80*a*, 80*b*. The arm members 120*a*, 120*b*, which constitute the robot 92, are engaged with the:crucibles 80*a*, 80*b* respectively so that the crucibles 80*a*, 80*b* may be opened and closed. Accordingly, the semisolidified metal 90 is reliably allowed to fall, and it can be easily supplied to the slurry-introducing port 24 merely by moving the crucibles 80*a*, 80*b* in the directions to make separation from each other at the position over the slurry-introducing port 24.

Therefore, in the second embodiment, the entire amount of the semisolidified metal 90 can be reliably discharged from the crucibles 80*a*, 80*b* with the simple arrangement without being affected, for example, by the temperature of the semisolidified metal 90 in the crucibles 80*a*, 80*b*, the shape of the crucibles 80*a*, 80*b*, and the weight of the semisolidified metal 90. Accordingly, the supply weight of the semisolidified metal 90 is not dispersed, which would be otherwise caused by the occurrence of any remaining matter of the semisolidified metal 90 in the crucibles 80*a*, 80*b*. Further, such an effect is obtained that it is possible to effectively prevent the semisolidified metal 90 to be newly produced in the crucibles 80*a*, 80*b* from being badly affected.

Figure 12:
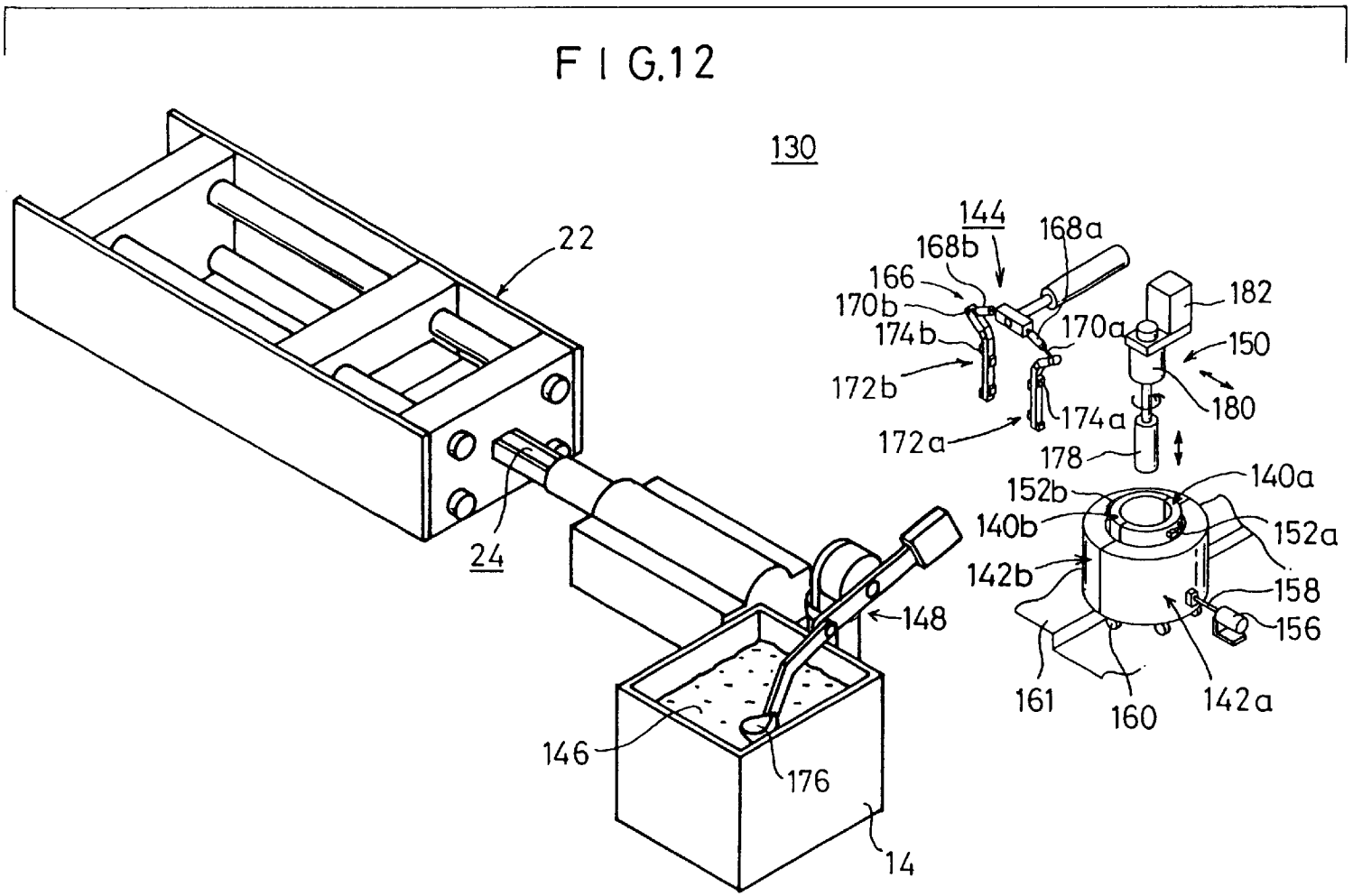
FIG. 12 shows an illustrative schematic perspective view depicting a production apparatus for carrying out a method for producing semisolidified metal according to a third embodiment of the present invention.

FIG. 12 shows an illustrative schematic perspective view depicting a production apparatus 130 for carrying out a method for producing semisolidified metal according to the third embodiment of the present invention.

The production apparatus 130 comprises divided type crucibles 140*a*, 140*b*; divided type crucible holders 142*a*, 142*b*; a robot 144 for transporting the crucibles 140*a*, 140*b*; a molten metal-feeding means 148 for feeding molten metal 146 in an amount of one shot into the crucibles 140*a*, 140*b*; and an agitator 150 for cooling and agitating the molten metal 146 in the crucibles 140*a*, 140*b*.

A pair of projections 152*a*, 152*b* are formed to expand on outer circumferential portions of the crucibles 140*a*, 140*b*. The crucible holder 142*a* is connected to a rod 158 which extends from a cylinder 156, and it is movable back and forth in directions of the arrow by the aid of a pulley 160. The crucible holder 142*b* is fixed to an installation plane 161. When the crucible holders 142*a*, 142*b* are mutually closed, a recess 162 is integrally formed therein. Heaters 164*a*, 164*b* are embedded in the crucible holders 142*a*, 142*b* respectively (see FIG. 13A).

An opening/closing mechanism 166 is installed to the robot 144. Upper ends of arm members 172*a*, 172*b* are connected to rods 170*a*, 170*b* which extend from cylinders 168*a*, 168*b* for constructing the opening/closing mechanism 166. Fastening means 174*a*, 174*b*, which are used to make engagement with the projections 152*a*, 152*b* provided on the side surfaces of the crucibles 140*a*, 140*b*, are provided on lower end sides of the arm members 172*a*, 172*b*.

The molten metal-feeding means 148 is provided with a ladle 176. The agitator 150 is provided with a chill block 178 having a relatively small diameter. The chill block 178 is rotatable by the aid of a driving mechanism 180. The driving mechanism 180 is installed to a movable base 182, and it is movable in the direction of the arrow (in the horizontal direction).

Figures 13A, 13B, 13C, 13D, 13E, 13F, 13G:
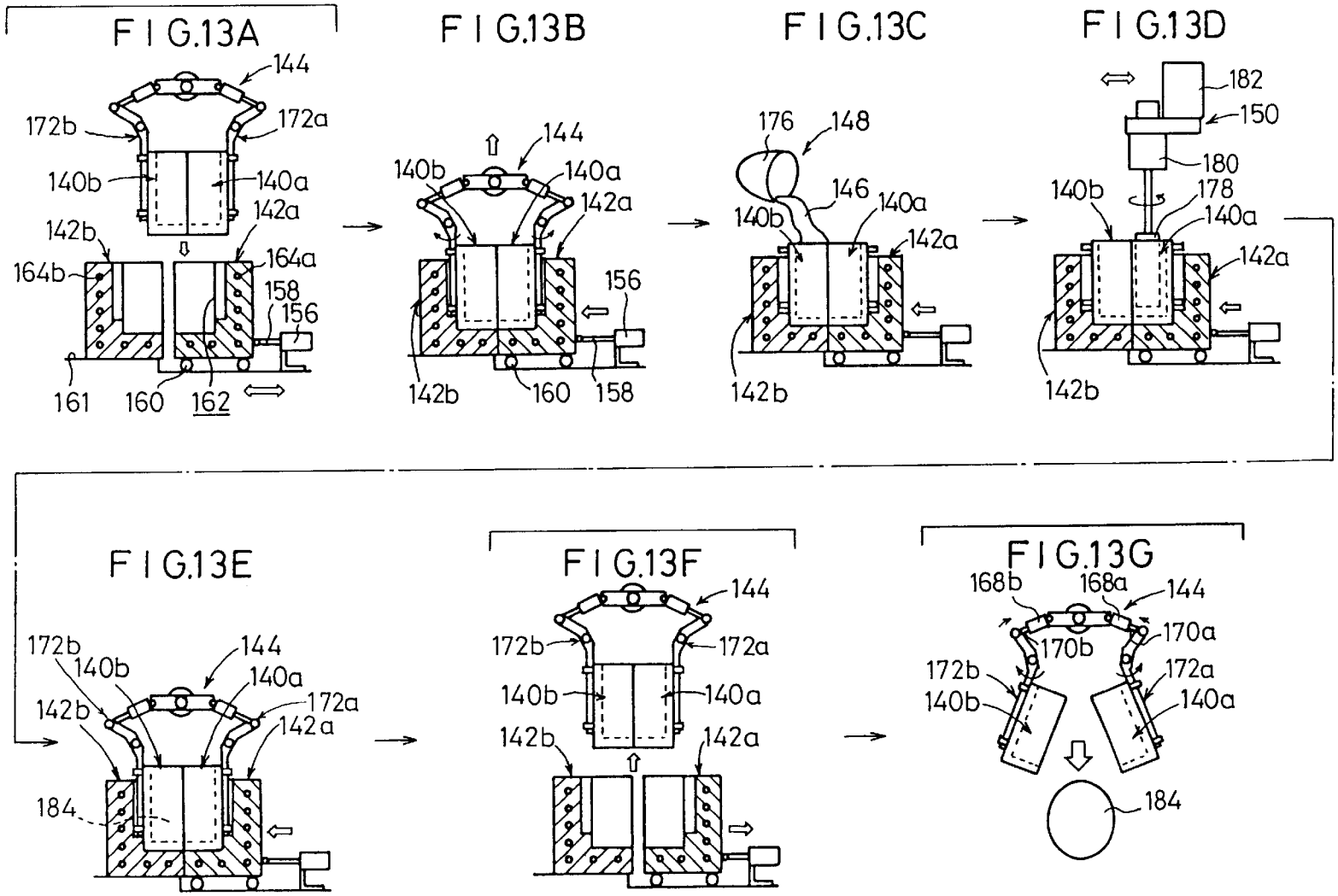
FIGS. 13A to 13G show steps illustrating the operation of the production apparatus.

In the third embodiment constructed as described above, the operation is firstly performed as shown in FIG. 13A. That is, in a state in which the crucible holder 142*a* is separated from the crucible holder 142*b*, the crucibles 140*a*, 140*b* are gripped by the robot 144, and they are inserted into the crucible holders 142*a*, 142*b*. Subsequently, the crucible holder 142*a* is moved toward the crucible holder 142*b* to be mutually closed in accordance with the driving action of the cylinder 156. The crucibles 140*a*, 140*b* are accommodated and held in the recess 162 which is integrally formed therebetween (see FIG. 13B).

Further, as shown in FIG. 13C, the molten metal 146 in the amount of one shot is fed into the crucibles 140*a*, 140*b* by the aid of the ladle 176 which constitutes the molten metal-feeding means 148. After that, as shown in FIG. 13D, the agitator 150 is operated. In the agitator 150, the chill block 178, which is cooled at a predetermined temperature, is rotated by the aid of the driving mechanism 180 while being immersed in the molten metal 146. The movable base 182 is moved back and forth in the horizontal direction. Accordingly, the molten metal 146 in the crucibles 140*a*, 140*b* is cooled and agitated to obtain the semisolidified metal 184 having a desired slurry state.

Subsequently, as shown in FIG. 13E, the arm members 172*a*, 172*b*, which construct the robot 144, enter the inside of the crucible holders 142*a*, 142*b* to grip the crucibles 140*a*, 140*b*. After that, the crucible holder 142*a* is operated to be open in accordance with the action of the cylinder 156, while the robot 144 is moved upwardly (see FIG. 13F). The robot 144 arranges the crucibles 140*a*, 140*b* corresponding to the predetermined slurry-introducing port 24. When the arm members 172*a*, 172*b* make swinging movement in directions to make separation from each other in accordance with the action of the cylinders 168*a*, 168*b*, then the crucibles 140*a*, 140*b* mutually make swinging movement in opening directions, and thus the semisolidified metal 184 falls to be supplied to the slurry-introducing port 24 (see FIG. 13G).

Therefore, in the third embodiment, the same effect as that of the second embodiment is obtained by using the divided type crucibles 140*a*, 140*b*.

Figure 14:
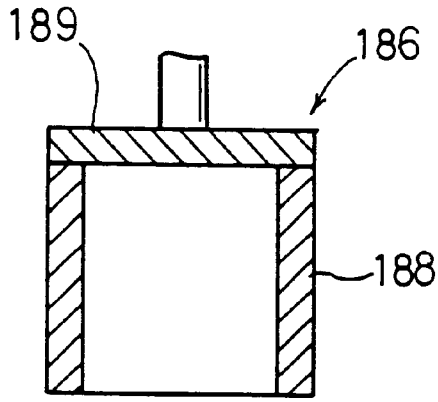
FIG. 14 illustrates a chill block having a cylindrical configuration.
Figure 15:
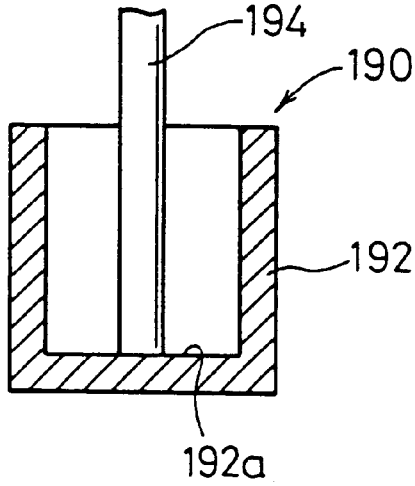
FIG. 15 illustrates a chill block having a bottom-equipped cylindrical configuration.

In the first to third embodiments, the chill blocks 46, 110, 178 are designed to have the columnar configuration. However, it is enough that at least the external shape has the columnar configuration. For example, a chill block 186 shown in FIG. 14 includes a cylindrical member 188, and an attachment plate 189 to which an end of the cylindrical member 188 is secured. A chill block 190 shown in FIG. 15 includes a bottom-equipped cylindrical member 192, and a shaft member 194 which is secured to an inner bottom portion 192*a* of the cylindrical member 192.

Figure 16:
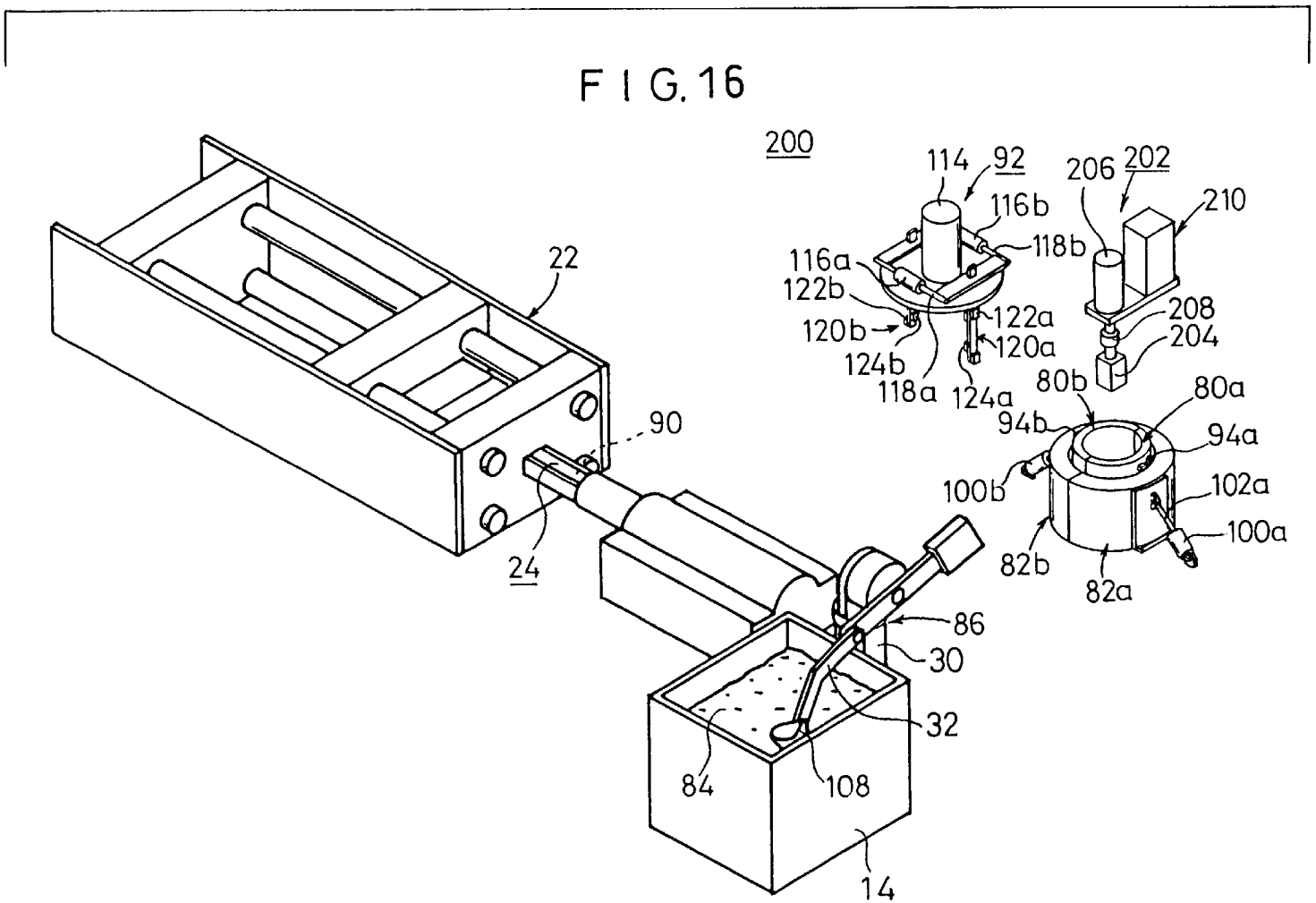
FIG. 16 shows an illustrative schematic perspective view depicting a production apparatus for carrying out a method for producing semisolidified metal according to a fourth embodiment of the present invention.

FIG. 16 shows an illustrative schematic perspective view depicting a production apparatus 200 for carrying out a method for producing semisolidified metal according to the fourth embodiment of the present invention. The same constitutive components as those of the production apparatus 70 according to the second embodiment shown in FIG. 10 are designated by the same reference numerals, detailed explanation of which will be omitted.

Figure 17:
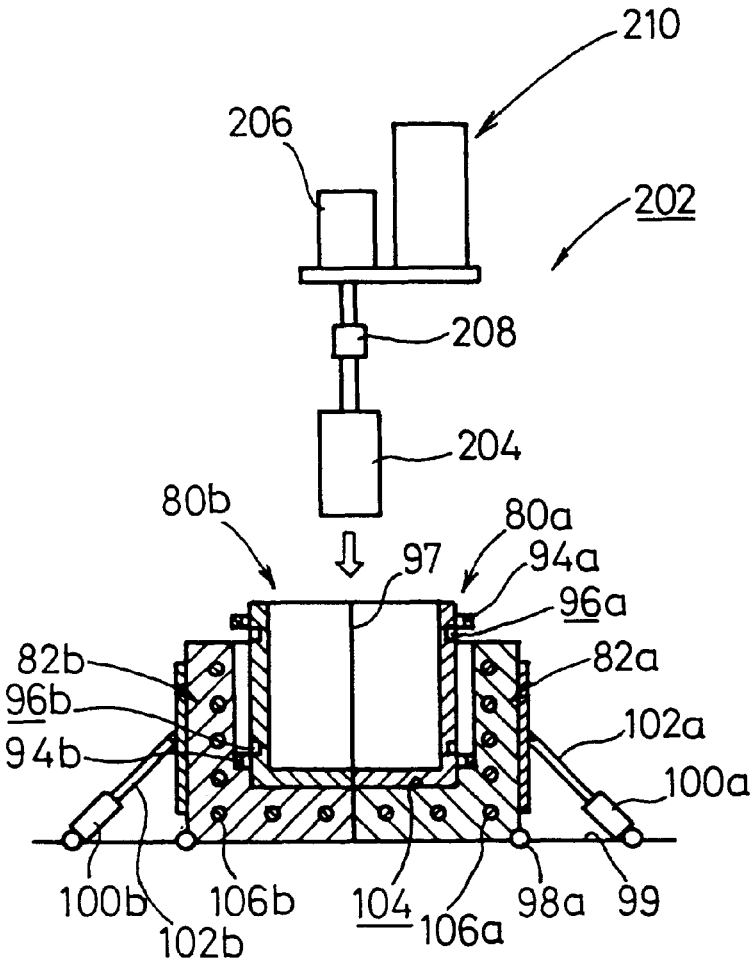
FIG. 17 illustrates an agitator which constructs the production apparatus.

The production apparatus 200 is provided with an agitator 202. As shown in FIGS. 16 and 17, a chill block (cooling member) 204, which constructs the agitator 202, is detachably arranged with respect to a rotary section 206 with a coupler 208 made of ceramics intervening therebetween, at a position over crucible holders 82*a*, 82*b*. The chill block 204 is composed of, for example, a material such as copper and stainless steel which is not melted at a melting temperature of aluminum molten metal to be used as the molten metal 84. The external shape of the chill block 204 is designed to have a quadratic prism-shaped configuration, with a draft formed downwardly.

The rotary section 206 rotates and drives the chill block 204. The rotary section 206 is constructed to be movable upwardly and downwardly in an integrated manner together with the chill block 204 by the aid of a moving section 210, and it is moved along a spiral configuration in the horizontal direction (see FIG. 18). That is, the moving section 210 has two functions of an elevator means and a spiral movable means. A driving mechanism is constructed by the rotary section 206 and the moving section 210.

Figure 18:
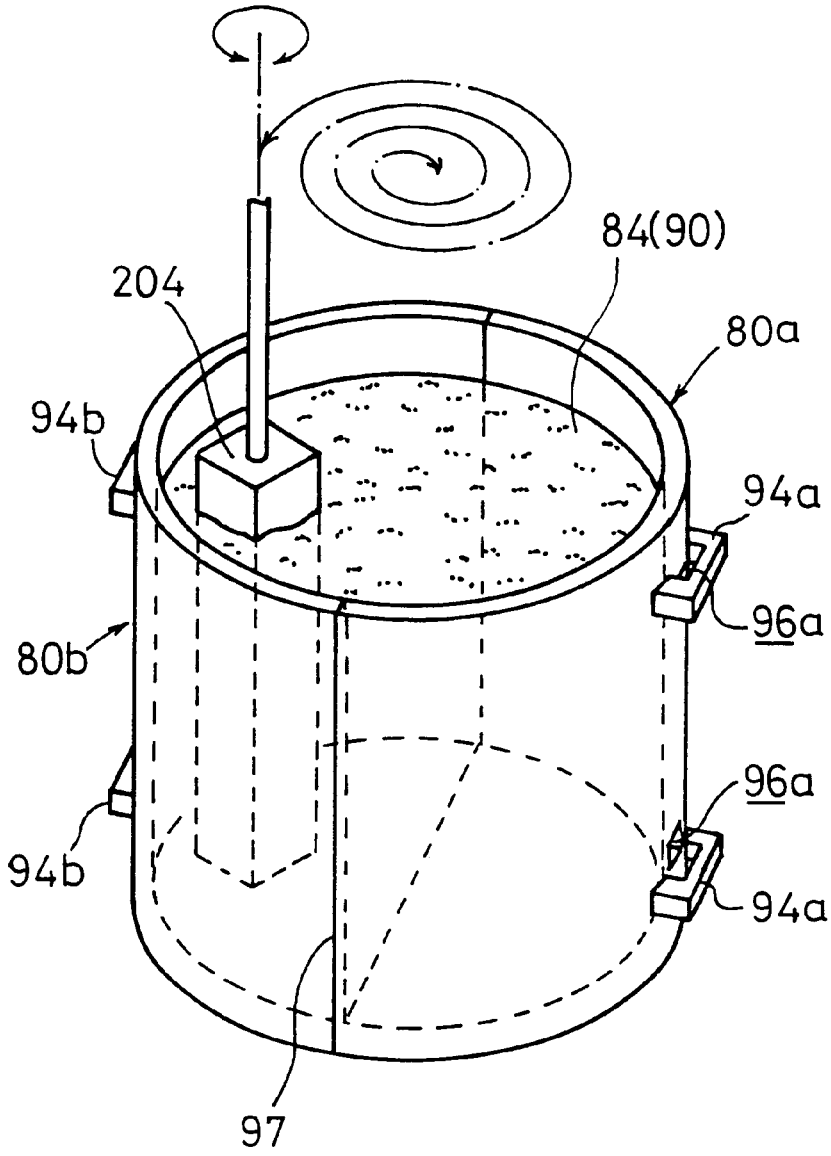
FIG. 18 shows an illustrative schematic perspective view depicting the agitator.

As shown in FIG. 18, in the production apparatus 200 according to the fourth embodiment constructed as described above, the molten metal 84 in the crucibles 80*a*, 80*b* is cooled by the chill block 204 which is maintained at a temperature lower than the temperature of the molten metal 84. The molten metal 84 is agitated by moving the chill block 204 in the spiral configuration in the horizontal direction along the shape of the crucibles 80*a*, 80*b* while rotating the chill block 204. Accordingly, no directivity occurs during the cooling of the molten metal 84 in the crucibles 80*a*, 80*b*. It is possible to quickly obtain the desired semisolidified metal 90 formed into the slurry uniformly and reliably as a whole. Therefore, it is unnecessary to reheat the semisolidified metal 90. The semisolidified metal 90 can be directly supplied to the slurry-introducing port 24 of the forming machine 22.

Accordingly, the following effects are obtained. That is, it is possible to always obtain the stable semisolidified metal 90 for every one shot. Further, it is unnecessary to provide the equipment such as the reheating unit, and it is possible to produce the semisolidified metal 90 economically and efficiently. The external shape of the chill block 204 is designed to have the quadratic prism-shaped configuration. Therefore, it is possible to reliably agitate the molten metal 84. The chill block 204 has the draft formed downwardly. Thus, the chill block 204 can be smoothly withdrawn from the semisolidified metal 90.

Figure 19:
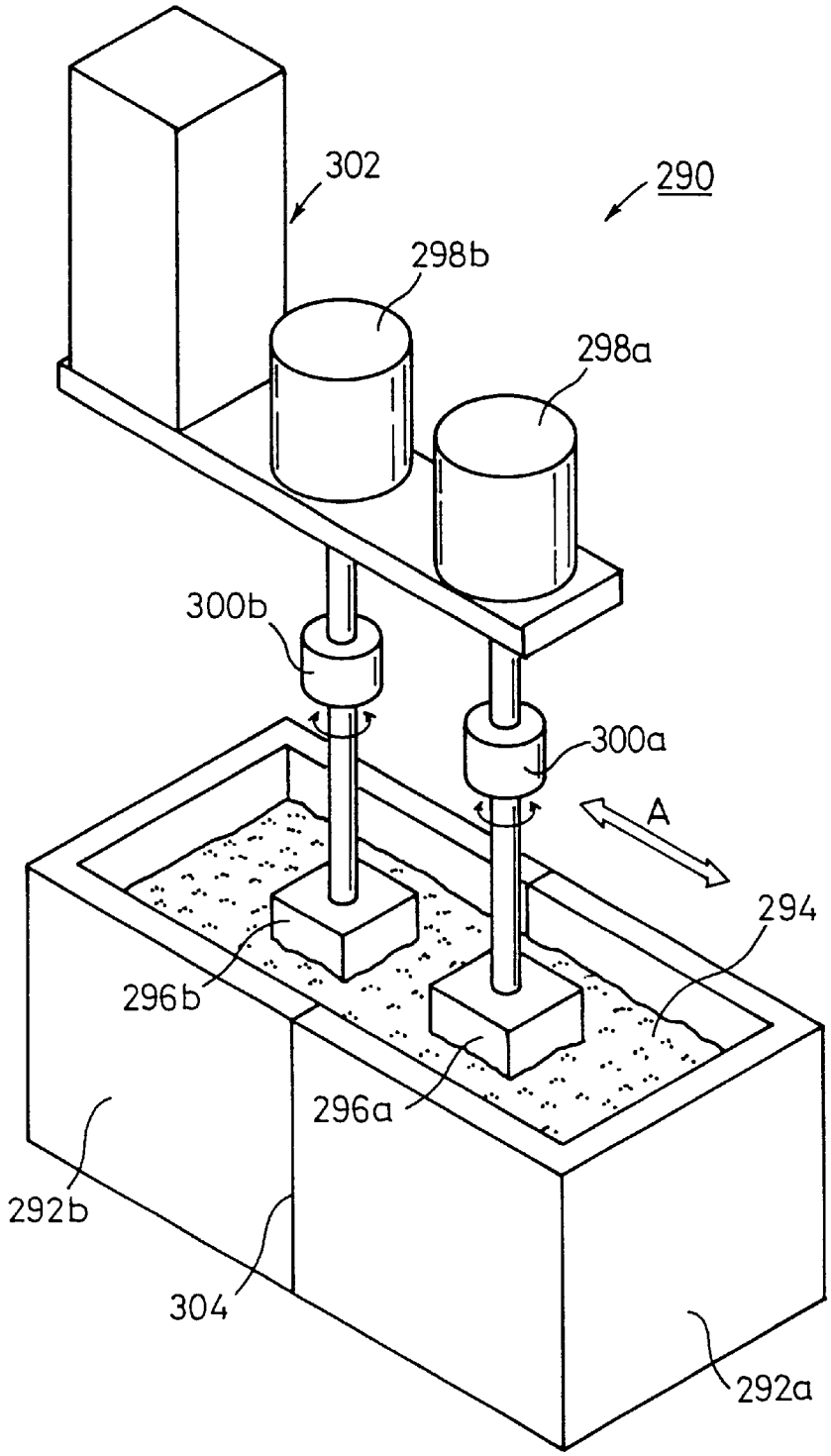
FIG. 19 shows an illustrative schematic perspective view depicting an agitator which constructs a production apparatus for carrying out a method for producing semisolidified metal according to a fifth embodiment of the present invention.

FIG. 19 shows an illustrative schematic perspective view depicting an agitator 290 which constructs a production apparatus for carrying out a method for producing semisolidified metal according to the fifth embodiment of the present invention.

The agitator 290 is provided with a pair of chill blocks (cooling members) 296*a*, 296*b* for cooling and agitating molten metal 294 in divided type crucibles 292*a*, 292*b*. The chill blocks 296*a*, 296*b* are arranged detachably with respect to rotary sections 298*a*, 298*a* with couplers 300*a*, 300*b* made of ceramics intervening therebetween. The chill blocks 296*a*, 296*b* are made of, for example, copper or stainless steel, in the same manner as the chill block 204. The chill blocks 296*a*, 296*b* are designed to have a quadratic prism-shaped external shape, and they have a draft formed downwardly.

The rotary sections 298*a*, 298*b* rotate and drive the chill blocks 296*a*, 296*b*. On the other hand, the rotary sections 298*a*, 298*b* are movable upwardly and downwardly in an integrated manner together with the chill blocks 296*a*, 296*b* by the aid of a moving section 302, and they make reciprocating movement in the horizontal direction along the longitudinal direction (direction of the arrow A) of the crucibles 292*a*, 292*b*. That is, the moving section 302 has two functions of an elevator means and a horizontally moving means.

The crucibles 292*a*, 292*b* are designed to have a rectangular configuration in a state of making tight contact with each other. A heat-resistant packing 304 is interposed between their joining surfaces. The crucibles 292*a*, 292*b* are arranged on unillustrated divided type crucible holders. An integrated type crucible may be adopted in place of the divided type crucibles 292*a*, 292*b*.

In the fifth embodiment constructed as described above, the molten metal 294 in an amount of one shot is firstly fed into the inside of the crucibles 292*a*, 292*b* which are allowed to make tight contact with each other. After that, the chill blocks 296*a*, 296*b* are arranged at positions over the crucibles 292*a*, 292*b* by the aid of the moving section 302. Subsequently, the chill blocks 296*a*, 296*b* are moved downwardly while being rotated in accordance with the action of the rotary sections 298*a*, 298*b*.

The chill blocks 296*a*, 296*b* are moved in a reciprocating manner in the horizontal direction in accordance with the action of the moving section 302, after the chill blocks 296*a*, 296*b* are immersed in the molten metal 294 in the crucibles 292*a*, 292*b*, or simultaneously with the rotary driving. Accordingly, the chill blocks 296*a*, 296*b* cool the molten metal 294 in the crucibles 292*a*, 292*b*, and they agitate the molten metal 294 along the shape of the crucibles 292*a*, 292*b*.

As described above, in the fifth embodiment, the chill blocks 296*a*, 296*b* make the reciprocating movement along the longitudinal direction (direction of the arrow A) of the crucibles 292*a*, 292*b* while being rotated. Accordingly, the molten metal 294 can be agitated reliably and effectively over the entire interior of the crucibles 292*a*, 292*b*. Therefore, the same effects as those obtained in the fourth embodiment are obtained, for example, such that it is possible to obtain the desired semisolidified metal 90 in the satisfactory slurry state which is uniform as a whole and which has no directivity of cooling, in the crucibles 292*a*, 292*b*.

Figure 20:
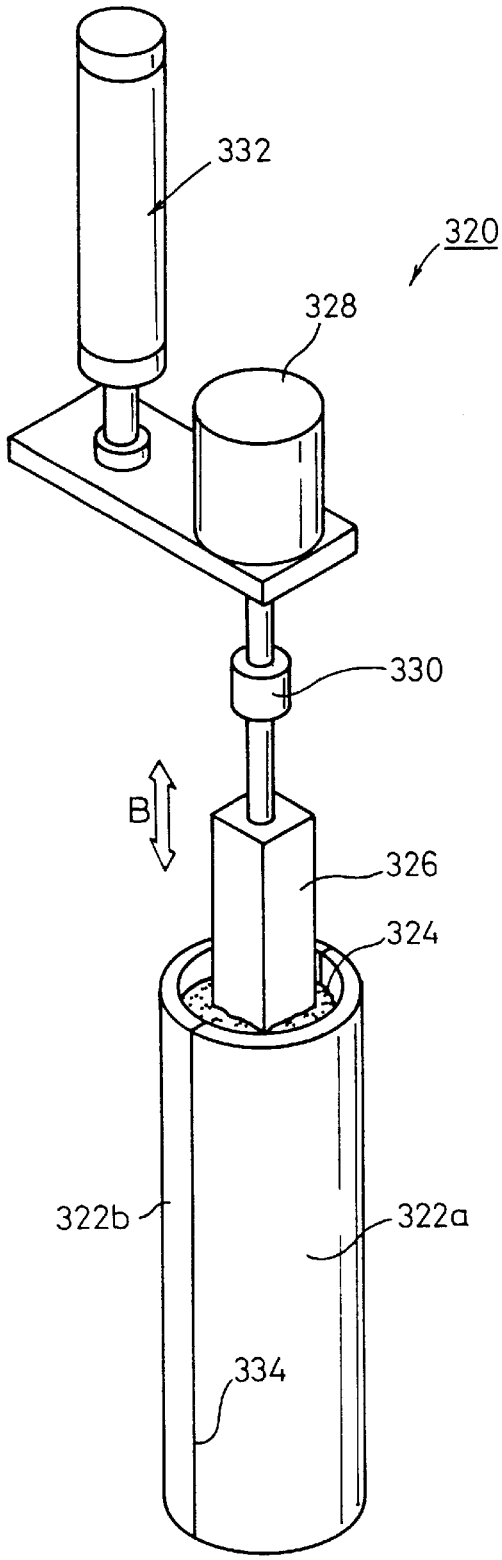
FIG. 20 shows an illustrative schematic perspective view depicting an agitator which constructs a production apparatus for carrying out a method for producing semisolidified metal according to a sixth embodiment of the present invention.

FIG. 20 shows an illustrative schematic perspective view depicting an agitator 320 which constructs a production apparatus for carrying out a method for producing semisolidified metal according to the sixth embodiment of the present invention.

The agitator 320 is provided with a chill block (cooling member) 326 for cooling and agitating molten metal 324 in divided type crucibles 322*a*, 322*b*. The chill block 326 is arranged detachably with respect to a, rotary section 328 with a coupler 330 made of ceramics intervening therebetween. The chill block 326 is made of, for example, copper or stainless steel, in the same manner as the chill block 204 described above. The chill block 326 is designed to have a quadratic prism-shaped external shape, and it has a draft formed downwardly.

A rotary section 328 rotates and drives the chill block 326. On the other hand, the rotary section 328 is movable upwardly and downwardly in an integrated manner together with the chill block 326 by the aid of a moving section 332. That is, the moving section 332 has a function to serve as a vertically moving means for making reciprocating movement of the chill block 326 in the longitudinal direction (direction of the arrow B) of the crucibles 322*a*, 322*b*.

The crucibles 322*a*, 322*b* are designed to have a cylindrical configuration in a state of making tight contact with each other. A heat-resistant packing 334 is interposed between their joining surfaces. The crucibles 322*a*, 322*b* are arranged on unillustrated divided type crucible holders. An integrated type crucible may be adopted in place of the divided type crucibles 322*a*, 322*b*.

In the sixth embodiment constructed as described above, the molten metal 324 in an amount of one shot is firstly fed into the inside of the crucibles 322*a*, 322*b* which are allowed to make tight contact with each other. After that, the chill block 326 is arranged at a position over the crucibles 322*a*, 322*b* by the aid of the moving mechanism 332.

Subsequently, the chill block 326 is moved downwardly by the aid of the moving section 332 while being rotated in accordance with the action of the rotary section 328. The chill block 326 is immersed in the molten metal 324 in the crucibles 322*a*, 322*b*, and then it makes reciprocating movement in the vertical direction in accordance with the action of the moving section 332. Accordingly, the chill block 326 cools the molten metal 324 in the crucibles 322*a*, 322*b*, and it agitates the molten metal 324 along the shape of the crucibles 322*a*, 322*b*.

As described above, in the sixth embodiment, the chill block 326 makes the reciprocating movement in the longitudinal direction (direction of the arrow B) of the crucibles 322*a*, 322*b* while being rotated. Accordingly, the molten metal 324 can be agitated reliably and effectively over the entire interior of the crucibles 322*a*, 322*b*. Therefore, the same effects as those obtained in the fourth and fifth embodiments are obtained, for example, such that it is possible to obtain the desired semisolidified metal 90 in the satisfactory slurry state which is uniform as a whole and which has no directivity of cooling.

Figure 21:
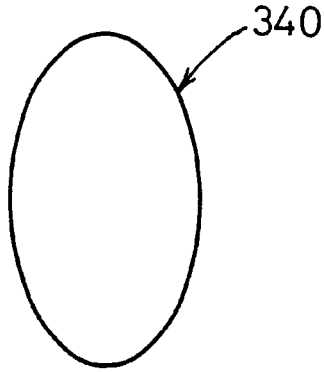
FIG. 21 illustrates a chill block designed to have an external shape of an elliptical configuration.
Figure 22:
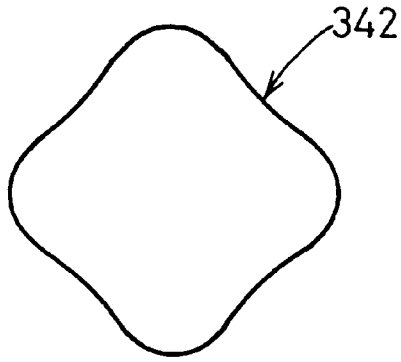
FIG. 22 illustrates a chill block designed to have an external shape of a composite elliptical configuration.
Figure 23:
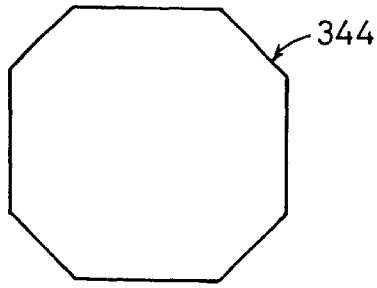
FIG. 23 illustrates a chill block designed to have an external shape of a chamfered rectangular configuration.
Figure 24:
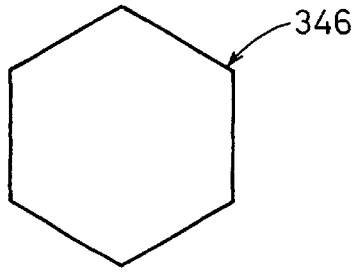
FIG. 24 illustrates a chill block designed to have an external shape of a hexagonal configuration.
Figure 25:
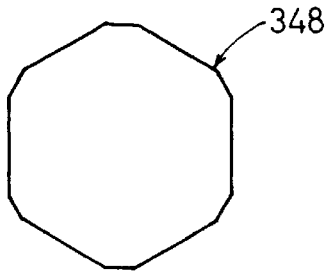
FIG. 25 illustrates a chill block designed to have an external shape of a chamfered hexagonal configuration.

In the fourth to sixth embodiments, each of the chill blocks 204, 296*a*, 296*b*, 326 is designed to have the rectangular configuration. However, there is no limitation thereto. For example, it is also allowable to use a chill block 340 designed to have an external shape of an elliptical configuration (see FIG. 21), a chill block 342 designed to have an external shape of a composite elliptical configuration (see FIG. 22), a chill block 344 designed to have an external shape of a chamfered rectangular configuration (see FIG. 23), a chill block 346 designed to have an external shape of a hexagonal configuration (see FIG. 24), and a chill block 346 designed to have an external shape of chamfered hexagonal configuration (see FIG. 25).

Figure 26:
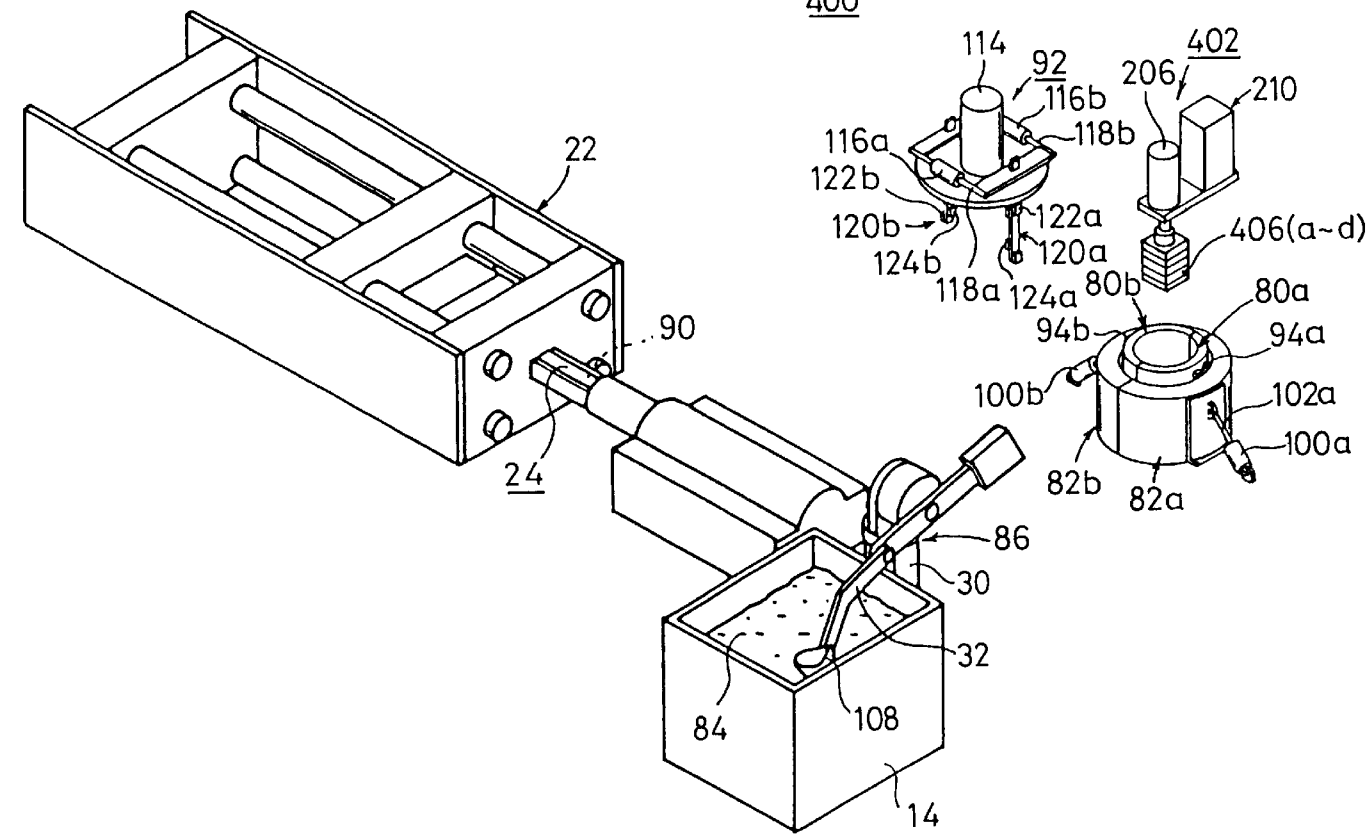
FIG. 26 shows an illustrative schematic perspective view depicting an apparatus for producing seimsolidified metal according to a seventh embodiment of the present invention.

FIG. 26 shows an illustrative schematic perspective view depicting an apparatus 400 for producing semisolidified metal according to the seventh embodiment of the present invention. The same constitutive components as those of the production apparatus 200 according to the fourth embodiment shown in FIG. 16 are designated by the same reference numerals, detailed explanation of which will be omitted.

Figure 27:
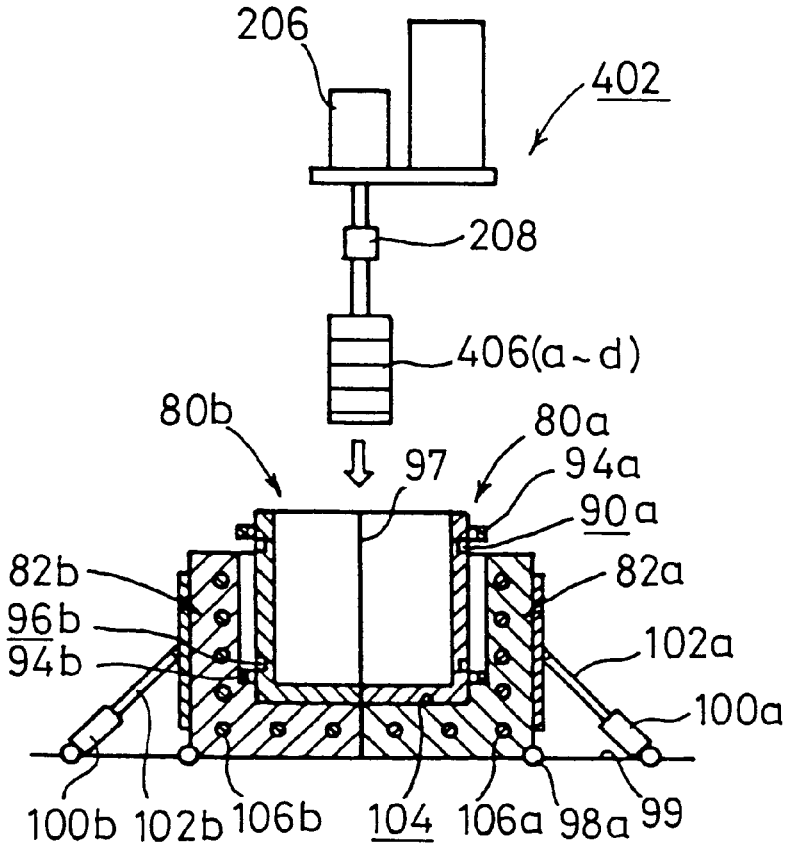
FIG. 27 illustrates an agitator which constructs the production apparatus.
Figure 28:
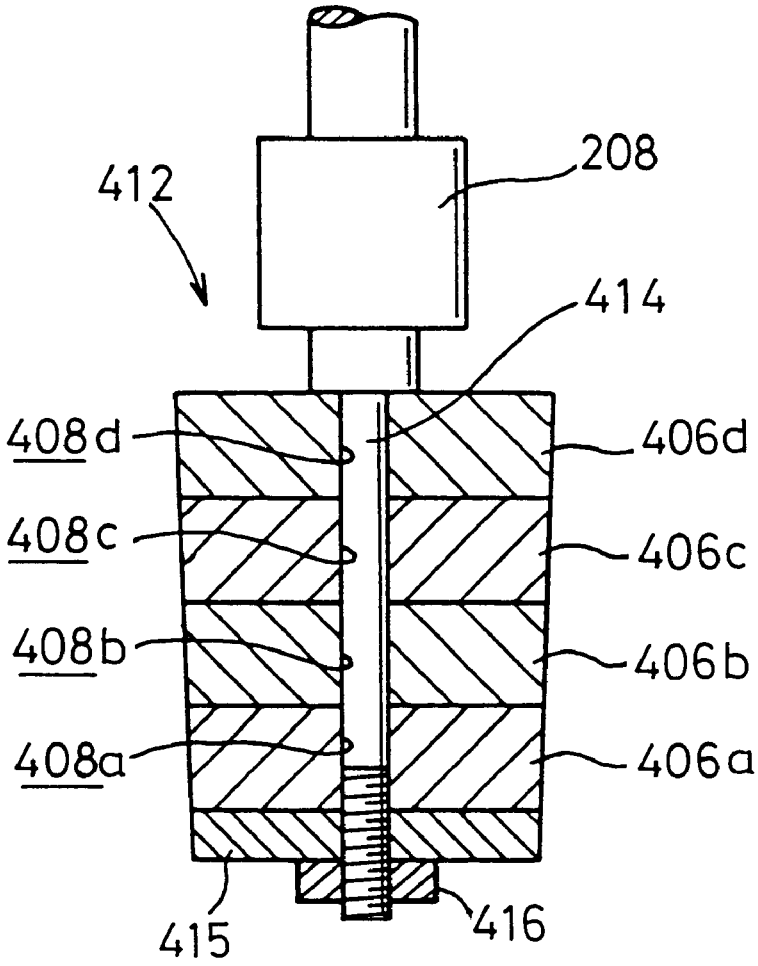
FIG. 28 illustrates, in cross section, chill blocks which construct the agitator.

The production apparatus 400 is provided with an agitator 402. A plurality of chill blocks (cooling members) 406*a* to 406*d*, which construct the agitator 402, are detachably connected to a rotary section 206 with a coupler 208 made of ceramics intervening therebetween, at a position over crucible holders 82*a*, 82*b*. The chill blocks 406*a* to 406*d* are composed of, for example, a material such as copper and stainless steel which is not melted at a melting temperature of aluminum molten metal to be used as the molten metal 84. As shown in FIGS. 26 to 28, the external shape of the entire chill blocks 406*a* to 406*d* is designed to have a quadratic prism-shaped configuration, with a draft formed downwardly.

As shown in FIG. 28, through-holes 408*a* to 408*d* are formed at respective central portions of the chill blocks 406*a* to 406*d*. An arbitrary number of the chill blocks 406*a* to 406*d* can be held in an integrated manner with respect to the rotary section 206 by the aid of a fixing means 412. The fixing means 412 includes a screw shaft (shaft member) 414 for being integrally inserted into the through-holes 408*a* to 408*d* of the stacked chill blocks 406*a* to 406*d*, a nut member (fixture) 416 for being screwed on the lower end of the screw shaft 414, and a support plate 415 for supporting the chill blocks 406*a* to 406*d*. The upper end of the screw shaft 414 can be detachably connected to the coupler 208.

In the case of the production apparatus 400 constructed as described above, when the weight of the molten metal 84 in the amount of one shot is changed depending on the change of the part to be formed, the number of chill blocks 406*a* to 406*d* installed to the rotary section 206 is increased or decreased. Specifically, when the weight of the molten metal 84 in the amount of one shot is decreased, the chill blocks 406*a* to 406*d* are decreased, for example, to the chill blocks 406*a* to 406*c*. On the other hand, when the weight of the molten metal 84 in the amount of one shot is increased, a predetermined number of chill blocks (not shown) may be stacked on the chill blocks 406*a* to 406*d*.

As described above, in the seventh embodiment, the molten metal 84 in the crucibles 80*a*, 80*b* is cooled with the predetermined number of chill blocks 406*a* to 406*d*, and the chill blocks 406*a* to 406*d* are rotated in an integrated manner by the aid of the rotary section 206 to agitate the molten metal 84. Accordingly, the following effects are obtained. That is, no directivity occurs during the cooling of the molten metal 84 in the crucibles 80*a*, 80*b*. It is possible to extremely quickly and efficiently obtain the desired semisolidified metal 22 formed into the slurry uniformly and reliably as a whole.

Further, when the weight of the molten metal 84 in the amount of one shot is changed, it is enough that the number of chill blocks 406*a* to 406*d* is increased or decreased depending on the weight of the molten metal 84. It is possible to efficiently and highly accurately produce the semisolidified metal 90 for forming a variety of different parts. Accordingly, the following advantages are obtained. That is, it is unnecessary to prepare any exclusive cooling means corresponding to the change of the weight of the molten metal 84. It is possible to effectively reduce the equipment cost.

Figure 29:
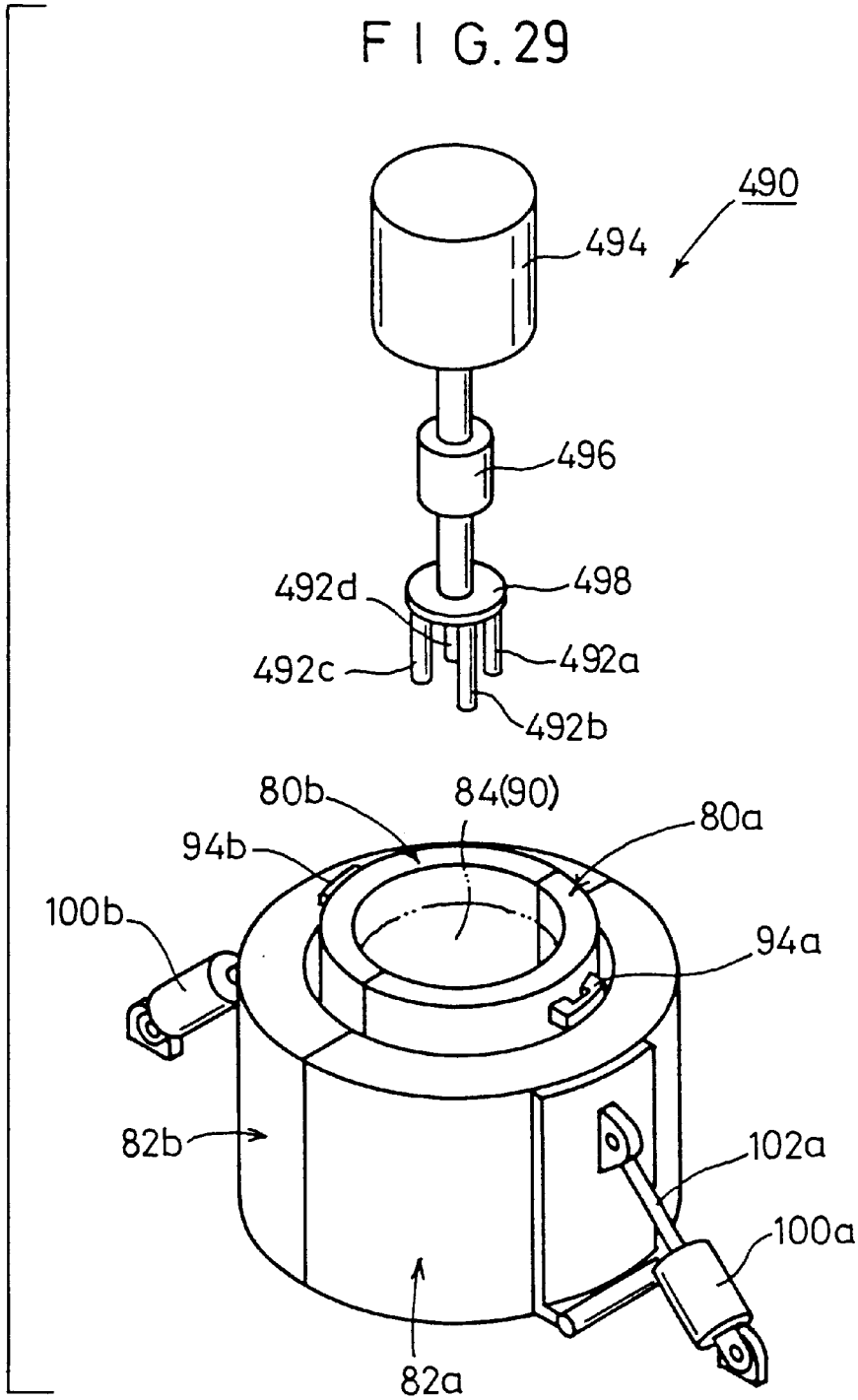
FIG. 29 shows an illustrative schematic perspective view depicting an apparatus for producing semisolidified metal according to an eighth embodiment of the present invention.

FIG. 29 shows an illustrative schematic perspective view depicting an apparatus 490 for producing semisolidified metal according to the eighth embodiment of the present invention. The same constitutive components as those of the production apparatus 400 according to the seventh embodiment are designated by the same reference numerals, detailed explanation of which will be omitted.

The production apparatus 490 includes a plurality of chill blocks (cooling members) 492*a* to 492*d* which also possess the agitating function. The chill blocks 492*a* to 492*d* are detachably arranged with respect to the driving mechanism 494 with a coupler 496 made of ceramics intervening therebetween. The chill blocks 492*a* to 492*d* are made of, for example, copper or stainless steel, and their upper ends are integrated into one unit with a connecting section 498. The connecting section 498 is detachable with respect to the coupler 496. The external shape of each of the chill blocks 492*a* to 492*d* is designed to have a columnar configuration, and each of the chill blocks 492*a* to 492*d* has a draft formed downwardly.

In the eighth embodiment constructed as described above, the molten metal 84 in an amount of one shot is fed into the crucibles 80*a*, 80*b*. After that, the chill blocks 492*a* to 492*d* are moved downwardly while being rotated by the aid of the driving mechanism 494, and they are immersed in the molten metal 84 in the crucibles 80*a*, 80*b*. Accordingly, the molten metal 84 in the crucibles 80*a*, 80*b* is cooled and agitated to obtain the semisolidified metal 90 having a desired slurry state.

Accordingly, in the eighth embodiment, the four chill blocks 492*a* to 492*d* are operated in an integrated manner to agitate the molten metal 84 while cooling the molten metal 84 in the crucibles 80*a*, 80*b*. Therefore, even when the weight of the molten metal 84 is especially large, an effect is obtained such that the desired semisolidified metal 90 can be obtained efficiently and quickly.

Figure 30:
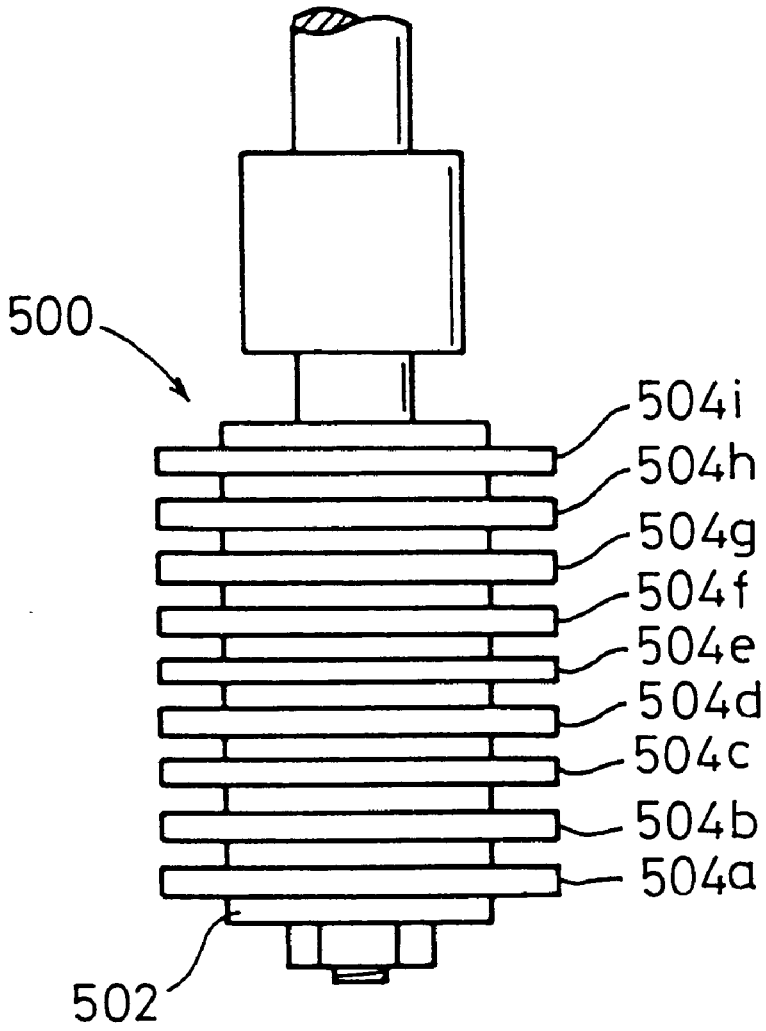
FIG. 30 illustrates a chill block which constructs an apparatus for producing semisolidified metal according to a ninth embodiment of the present invention.

FIG. 30 illustrates a chill block 500 which constructs an apparatus for producing semisolidified metal according to the ninth embodiment of the present invention.

The chill block 500 is provided with a plurality of rib sections 504*a* to 504*i* which are integrally formed on the outer circumference of a columnar section 502 while being separated from each other by predetermined spacing distances in the axial direction. Therefore, in the ninth embodiment, when the chill block 500 is rotated in the molten metal 84, the molten metal 84 is cooled and agitated quickly and smoothly by the aid of the plurality of rib sections 504*a* to 504*i*. Thus, it is possible to obtain the same effects as those obtained in the seventh and eighth embodiments.

Figure 31:
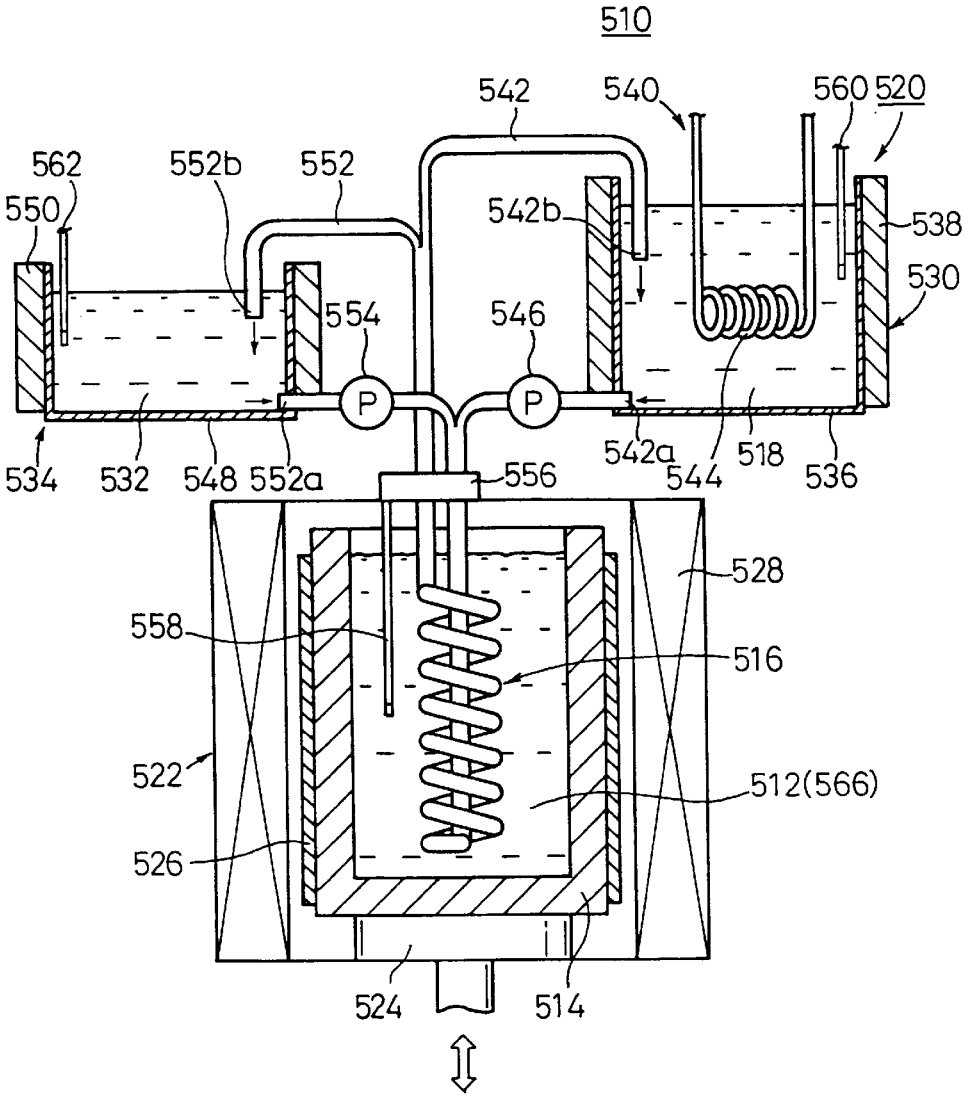
FIG. 31 shows an illustrative schematic view, with partial cross section, depicting an apparatus for producing semisolidified metal according to a tenth embodiment of the present invention.

FIG. 31 shows an illustrative schematic view, with partial cross section, depicting an apparatus 510 for producing semisolidified metal according to the tenth embodiment of the present invention.

The production apparatus 510 comprises a heat-insulating crucible 514 for holding molten metal 512 composed of melted metal in a predetermined amount (amount of one shot); a coil-shaped cooling member 516 for cooling the molten metal 512 in the crucible 514 to a predetermined temperature; a cooling mechanism 520 for supplying, to the inside of the cooling member 516, first liquid metal 518 as a cooling medium maintained at a temperature which is not more than the temperature of the molten metal 512; and an electromagnetic agitation mechanism (driving mechanism) 522 for agitating the molten metal 512 by the aid of the cooling member 516.

The crucible 514 is made of, for example, silicon nitride. The crucible 514 is arranged on an elevator base 524. A heating heater 526 is installed to the outer circumference of the crucible 514. The elevator base 524 is movable upwardly and downwardly by the aid of an unillustrated driving means, and it is designed to be rotatable, if necessary. A coil section 528, which constructs the electromagnetic agitation mechanism 522, is arranged to surround the crucible 514 in the vicinity of the elevator base 524.

The cooling mechanism 520 includes a first supply means 530 for supplying first liquid metal 518 into the cooling member 516 in order to cool the molten metal 512 to a predetermined temperature, and a second supply means 534 for supplying, into the cooling member 516, second liquid metal 532 which is a heating medium having a temperature higher than a liquefying temperature of solidified matters in order to remove the solidified matters adhered to the surface of the cooling member 516. The molten metal 512 is melted metal composed of, for example, aluminum, alloy thereof, magnesium, or alloy thereof. The first and second liquid metals 518, 532 are stannum or stannum alloy.

The first supply means 530 includes a first storage tank 536 for storing the first liquid metal 518; a first heating furnace (first heating section) 538 for keeping the temperature of the first liquid metal 518 in the first storage tank 536; a heat exchanger 540 for cooling the first liquid metal 518 by performing heat exchange with respect to the first liquid metal 518; and a first circulating passage 542 for circulating the first liquid metal 518 through the inside of the cooling member 516.

Figure 32:
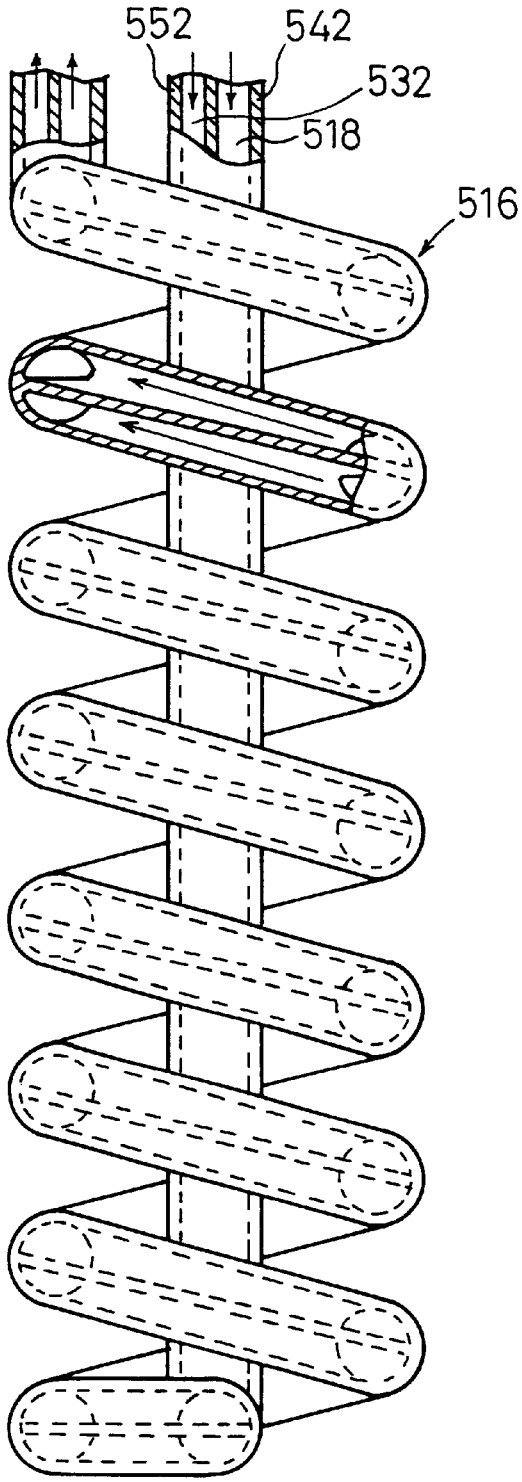
FIG. 32 illustrates a magnified view depicting a cooling member which constructs the production apparatus.

The heat exchanger 540 is provided with a heat exchange coil 544 for supplying cooling water thereinto. The heat exchange coil 544 is immersed in the first liquid metal 518 in the first storage tank 536. The first heating furnace 538 is arranged to circumscribe the first storage tank 536. The first circulating passage 542 is composed of a pipe made of SUS. An inlet end 542*a* thereof is connected to a lower end side of the first storage tank 536. An outlet end 542*b* thereof is immersed at a predetermined height position in the first liquid metal 518 at an upward portion of the first storage tank 536. As shown in FIG. 32, the first circulating passage 542 constitutes a part of the cooling member 516. A first electromagnetic pump 546 is arranged on the side of the end 542*a* (see FIG. 31).

The second supply means 534 includes a second storage tank 548 for storing the second liquid metal 532; a second heating furnace (second heating section) 550 for heating the second liquid metal 532 in the second storage tank 548; and a second circulating passage 552 for circulating the cooling member 532 through the inside of the cooling member 516.

The second heating furnace 550 is arranged to circumscribe the second storage tank 548. The second circulating passage 552 has its inlet end 552*a* which is joined to the lower side of the second storage tank 548, and its outlet end 552*b* which is immersed at a predetermined position in the second liquid metal 532 at an upper portion of the second storage tank 548. A second electromagnetic pump 554 is provided for the second circulating passage 552 in the vicinity of the side of the end 552*a*. The second circulating passage 552 is joined with the first circulating passage 542 at its intermediate portion to constitute a part of the cooling member 516 (see FIG. 32).

A first thermocouple (first detecting means) 558 for measuring the temperature of the molten metal is installed at the joined portion of the first and second circulating passages 542, 552 by the aid of a support member 556. The first thermocouple 558 detects the temperature of the molten metal 512 in the crucible 514. A second thermocouple (second detecting means) 560 for detecting the temperature of the first liquid metal 518 is arranged for the first storage tank 536 which constructs the first supply means 530. On the other hand, a third thermocouple (third detecting means) 562 for detecting the temperature of the second liquid metal 532 is arranged for the second storage tank 548 which constructs the second supply means 534.

Explanation will be made below for the operation of the production apparatus 510 according to the tenth embodiment constructed as described above.

Figures 33A, 33B, 33C, 33D:
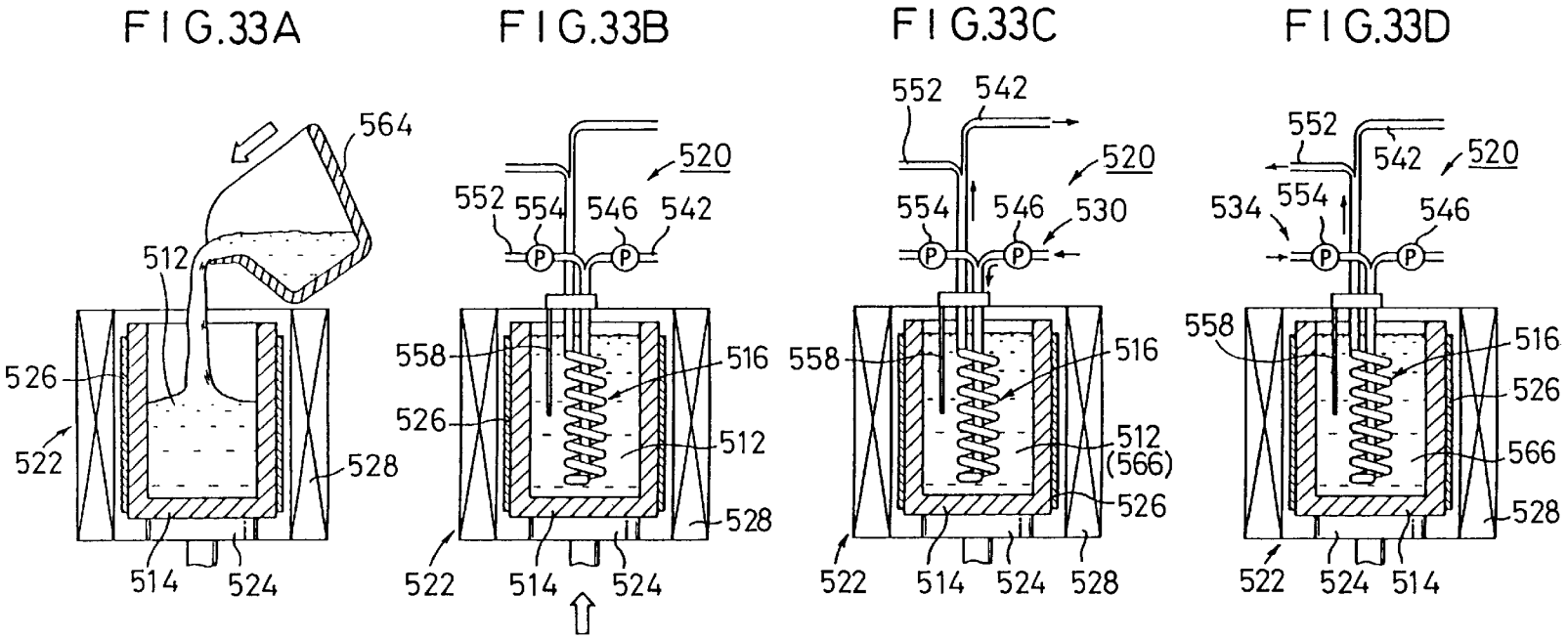
FIG. 33A illustrates a step of supplying molten metal to a crucible.
FIG. 33B illustrates a step of raising the crucible to immerse the cooling member in the molten metal.
FIG. 33C illustrates a step of supplying first liquid metal to the cooling member to cool and agitate the molten metal.
FIG. 33D illustrates a step of supplying second liquid metal to the cooling member after the semisolidified metal is produced.

At first, the operation is performed as shown in FIG. 33A. That is, for example, the molten metal 512 of aluminum alloy (AC2B), which is used as a material for the molten metal, is held at a temperature of 650° C. in an unillustrated molten metal-holding furnace. A feeder 564 ladles the molten metal 512 in an amount of one shot, for example, in an amount of 20 kg to be fed to the crucible 514. The heater 526 is installed to the crucible 514. The temperature of the molten metal 512 in the crucible 514 is maintained to be constant by the aid of the heater 526.

Subsequently, as shown in FIG. 33B, the elevator base 524, on which the crucible 514 is placed, is moved upwardly. The cooling member 516 is immersed in the molten metal 512 in the crucible 514. The cooling member 516 is a pipe made of SUS having an inner diameter of 20 mm, which is constructed to have a coil-shaped configuration with an entire length of 700 mm.

On the other hand, in the cooling mechanism 520, as shown in FIG. 31, the first liquid metal 518 is maintained at 250° C., and it is stored in an amount of 100 liters in the first storage tank 536 which constitutes the first supply means 530. The second liquid metal 532 is maintained at 600° C., and it is stored in an amount of 40 liters in the second storage tank 548 which constitutes the second supply means 534. The temperatures of the first and second liquid metals 518, 532 are detected by the second and third thermocouples 560, 562 respectively. The heat exchanger 540 and the first heating furnace 538 are operated on the basis of the result of the detection performed by the second thermocouple 560. Thus, the temperature of the first liquid metal 518 is maintained to be constant. On the other hand, the second heating furnace 550 is operated on the basis of the result of the detection performed by the third thermocouple 562. Thus, the temperature of the second liquid metal 532 is maintained to be constant.

The first electromagnetic pump 546 is operated so that the first liquid metal 518 in the first storage tank 536 is introduced into the inside of the cooling member 516 via the first circulating passage 542 at a flow rate of 20 liters/minute. After that, the first liquid metal 518 is returned from the end 542*b* to the inside of the first storage tank 536 (see FIG. 33C). Accordingly, the molten metal 512 in the crucible 514 is cooled by the aid of the cooling member 516 in which the first liquid metal 518 having the relatively low temperature is circulated through the inside. During this process, the coil section 528, which constitutes the electromagnetic agitation mechanism 522, is operated to agitate the molten metal 512 in the crucible 514.

The temperature of the molten metal 512 in the crucible 514 is detected by the first thermocouple 558. The cooling and the agitation are performed for the molten metal 512 until the detected temperature arrives at the preset semisolidification temperature. Therefore, the semisolidified metal 566, which has no directivity of cooling and which is formed into the slurry uniformly and successfully as a whole, is produced in the crucible 514 (see FIGS. 31 and 33C).

Subsequently, the operation of the first electromagnetic pump 546 is stopped, and the second electromagnetic pump 554 is operated. Accordingly, as shown in FIG. 33D, the liquid metal 532 in the second storage tank 548 is supplied to the inside of the cooling member 516 via the second circulating passage 552 at a flow rate of 20 liters/minute. The second liquid metal 532 is held at a temperature higher than the liquefaction temperature of the aluminum alloy used for the molten metal 512. Even when aluminum solidified matters adhere to the surface of the cooling member 516, the aluminum solidified matters can be dissolved again to reliably remove them. After that, the operation of the second electromagnetic pump 554 is stopped, and the elevator base 524 is moved downwardly to separate the crucible 514 from the cooling member 516.

Accordingly, the desired semisolidified metal 566 is obtained in the crucible 514. During this process, the first and second liquid metals 518, 532 are supplied to the cooling member 516 at the flow rate of 20 liters/minute by the aid of the first and second electromagnetic pumps 546, 554. Therefore, the molten metal 512 in the crucible 514 is cooled from 650° C. to the slurry temperature of 570° C. for about 1 minute. On the other hand, it is possible to effectively prevent the surface of the cooling member 516 from adhesion of aluminum solidified matters.

In the tenth embodiment, the first liquid metal 518, which is maintained at the predetermined cooling temperature, is supplied in the circulating manner to the inside of the cooling member 516 to cool the molten metal 512 in the state in which the cooling member 516 is immersed in the molten metal 512 in the crucible 514. Further, the electromagnetic agitation mechanism 522 is operated to agitate the molten metal 512. Accordingly, no directivity occurs during the cooling of the molten metal 512. It is possible to obtain the semisolidified metal 566 formed into the slurry uniformly and reliably as a whole.

The first and second thermocouples 558, 560 are used to detect the temperatures of the molten metal 512 and the first liquid metal 518 so that the temperature of the first liquid metal 518 is managed. Accordingly, it is unnecessary to reheat the semisolidified metal 566. Such an effect is obtained that the semisolidified metal 566 having a high quality can be efficiently obtained. Especially, it is advantageous that the temperature of the semisolidified metal 566 is managed easily and correctly, and the cooling speed for the molten metal 512 is improved so that the semisolidified metal 566 may be quickly produced all at once.

The tenth embodiment is provided with the second supply means 534 for supplying, to the inside of the cooling member 516, the second liquid metal 532 having the temperature higher than the liquefaction temperature of the molten metal material (for example, aluminum alloy) after the semisolidified metal 566 is produced. That is, it is feared that the aluminum solidified matters formed by the solidification of the molten metal 512 adhere to the surface of the cooling member 516 after performing the cooling and the agitation for the molten metal 512, resulting in formation of any solidified layer. If the solidified layer has a thick wall thickness, then it is feared that the aluminum solidified matters are oxidized to cause contamination into the molten metal 512 in the crucible 514 upon the next time shot, or the aluminum solidified matters cause the change of the cooling condition of the molten metal 512 and the dispersion of the amount of the molten metal.

In the tenth embodiment, the second liquid metal 532 having the relatively high temperature is supplied to the second circulating passage 552. Therefore, the aluminum solidified matters, which adhere to the surface of the cooling member 516, are dissolved again, and they are reliably removed from the surface. Accordingly, it is possible to efficiently obtain the semisolidified metal 566 having the high quality, and it is possible to stabilize the cooling condition.

In the tenth embodiment, the cooling member 516 is designed to have the coil-shaped configuration in which the first and second circulating passages 542, 552 are joined to one another in the integrated manner. However, the cooling member 516 may be designed to have various configurations such as a plate-shaped configuration, for example, corresponding to the volume and the shape of the crucible 514. That is, the cooling member 516 may be designed to have an optimum configuration so that the surface area is increased.

The electromagnetic agitation mechanism 522 is used to agitate the molten metal 512. However, in place thereof, it is possible to adopt a mechanical agitation structure. For example, the molten metal 512 may be agitated by rotating the crucible 514 itself, or by moving the crucible 514 in the horizontal direction together with the rotation of the crucible 514. Further, the following arrangement is also available. That is, the cooling member 516 itself may be rotated, or it may be designed to be movable in the horizontal direction.

INDUSTRIAL APPLICABILITY

As described above, in the present invention, the molten metal, which is supplied to the heat-insulating crucible, is agitated while being cooled by the aid of the cooling member. Therefore, the molten metal is formed into the slurry in the crucible uniformly and reliably as a whole. It is possible to easily and efficiently obtain the desired semisolidified metal having no directivity of cooling. Further, it is unnecessary to reheat the semisolidified metal. It is possible to reliably avoid the expensive equipment cost.

In the present invention, the molten metal in the crucible is cooled by the aid of the cooling member, and the molten metal is agitated by moving the cooling member along the shape of the crucible. Accordingly, the molten metal is formed into the slurry in the heat-insulating crucible uniformly and reliably as a whole. It is possible to easily and efficiently obtain the desired semisolidified metal having no directivity of cooling.

In the present invention, the molten metal in the crucible is cooled and agitated by the aid of the plurality of cooling members. Therefore, the directivity of cooling is excluded to be as less as possible, and it is possible to quickly and efficiently produce the desired semisolidified metal formed into the slurry uniformly and reliably as a whole.

In the present invention, the cooling member is immersed in the molten metal in the heat-insulating crucible. The molten metal is agitated in the state in which the cooling medium is supplied to the inside of the cooling member. Accordingly, no directivity occurs during the cooling of the molten metal, and it is possible to form the slurry of the molten metal quickly and reliably. Further, the desired semisolidified metal can be obtained efficiently and highly accurately by managing the temperature of the cooling medium.

In the present invention, the molten metal, which is contained in the divided type heat-insulating crucibles, is cooled and agitated by the aid of the cooling member to produce the semisolidified metal. After that, the heat-insulating crucibles are subjected to the opening/closing operation by the aid of the opening/closing mechanism. Accordingly, the semisolidified metal in the heat-insulating crucibles falls from the heat-insulating crucibles due to its own weight, and it is discharged therefrom. Accordingly, the directivity of cooling is excluded to be as less as possible, and it is possible to obtain the desired semisolidified metal formed into the slurry uniformly and reliably as a whole. Further, it is possible to discharge the semisolidified metal from the heat-insulating crucibles smoothly and reliably by using the simple structure.

What is claimed is:

1. A method for producing semisolidified metal, comprising the steps of:

supplying a predetermined amount of molten metal to a heat-insulating non-cooled crucible;

cooling said molten metal in said heat-insulating crucible by the aid of a cooling member used as an agitator, said cooling member being cooled to a predetermined temperature which is not more than a temperature of said molten metal, and agitating said molten metal;

agitating said molten metal by using said cooling member;

completing said agitation step after agitating said molten metal to give a predetermined slurry state;

withdrawing said cooling member to a position outside of said heat-insulating crucible;

subjecting said cooling member to a temperature control process in a cooling member treating unit;

removing solidified matters adhered to a surface of said cooling member after withdrawing said cooling member from said heat-insulating crucible;

costing said cooling member with a ceramic material after removing said solidified matters; and applying a drying treatment to said cooling member after coating said cooling member with said ceramic material prior to moving the cooling member to a position inside the heat-insulating crucible.

2. A method for producing semisolidified metal, comprising the steps of:

supplying a predetermined amount of molten metal to a heat-insulating crucible;

cooling said molten metal in said heat-insulating crucible by the aid of a cooling member cooled to a predetermined temperature which is not more than a temperature of said molten metal, said cooling member being displaceable from a position outside of said heat-insulating crucible to a position inside said heat-insulating crucible;

agitating said molten metal by moving said cooling member in a horizontal direction and/or in a vertical direction while rotating said cooling member;

completing said agitation step after agitating said molten metal to give a predetermined slurry state;

withdrawing said cooling member to said position outside of said heat-insulating crucible; and tilting said crucible so that said molten metal in said predetermined slurry state falls into a forming unit, wherein the step of supplying the predetermined amount of molten metal to a heat-insulating crucible is performed concurrently with the step of agitating said molten metal in at least two other heat-insulating crucible.

3. The method for producing said semisolidified metal according to claim 1, wherein an external shape of said cooling member is set to have a columnar configuration with a draft formed downwardly.

4. The method for producing said semisolidified metal according to claim 1, wherein an external shape of said cooling member is set to have a prism configuration with a draft formed downwardly.

5. The method for producing said semisolidified metal according to claim 1 or 2, wherein said cooling member is inserted into said heat-insulating crucible, and an open end of said heat-insulating crucible is closed by a lid member.

6. The method for producing said semisolidified metal according to claim 1 or 2, wherein a plurality of cooling members are provided.

7. An apparatus for producing semisolidified metal, comprising:

a heat-insulating crucible for holding predetermined amount of molten metal;

a cooling member for agitating and cooling said molten metal in said heat-insulating crucible to a predetermined temperature;

means for displacing said cooling member from a position outside of said heat-insulating crucible to a position inside said heat-insulating crucible;

a driving mechanism for agitating said molten metal by rotating said cooling member;

first temperature control means for controlling temperature of said cooling member after displacing said cooling member to said position outside said heat-insulating crucible;

air blow means for removing semi solidified metal from the cooling member;

coasting means for applying a coat of ceramic material to a surface of the cooling member; and drying mean for subjecting the cooling member to a drying treatment prior to displacing the cooling member to said position inside the heat-insulating crucible.

8. The apparatus for producing said semisolidified metal according to claim 7, wherein an external shape of said cooling member is set to have a columnar configuration with a draft formed downwardly.

9. An apparatus for producing semisolidified metal, comprising:

means for successively supplying a predetermined amount of molten metal into each of a plurality of heat-insulating crucibles;

a cooling member for each of said heat-insulating crucibles for agitating and cooling said molten metal to a predetermined temperature;

means for displacing said cooling members from a positions outside of said heat-insulating crucibles to positions inside said heat-insulating crucibles;

a driving mechanism for agitating said molten metal by moving said cooling members in a horizontal direction and/or in a vertical direction while rotating said cooling member;

wherein the means for supplying molten metal to one of the heat-insulating crucible operates concurrently with the agitating and cooling operation of the cooling members of at least two others of the heat-insulating crucibles.

10. The apparatus for producing said semisolidified metal according to claim 9, wherein said driving mechanism includes a horizontal moving means for making reciprocating movement of said cooling members in said horizontal direction.

11. The apparatus for producing said semisolidified metal according to claim 9, wherein said driving mechanism includes a spiral moving means for making spiral movement of said cooling members in said horizontal direction.

12. The apparatus for producing said semisolidified metal according to claim 9, wherein said driving mechanism includes a vertical moving means for making reciprocating movement of said cooling members in said vertical direction.

13. The apparatus for producing said semisolidified metal according to claim 9, wherein an external shape of each of the said cooling members is set to have a prism configuration with a draft formed downwardly.

* * * * *

UNITED STATES PATENT AND TRADEMARK OFFICE

CERTIFICATE OF CORRECTION

PATENT NO. : 6,681,836 B1
DATED : January 27, 2004
INVENTOR(S) : Sakamoto et al.

It is certified that error appears in the above-identified patent and that said Letters Patent is hereby corrected as shown below:

Title page,
Item [22], PCT Filed, change "October 15, 1999" to -- January 19, 1999 --.

Signed and Sealed this

Fourteenth Day of September, 2004

JON W. DUDAS
*Director of the United States Patent and Trademark Office*